US009944354B1

(12) United States Patent
O'Neal et al.

(10) Patent No.: US 9,944,354 B1
(45) Date of Patent: Apr. 17, 2018

(54) EXTENDABLE MULTIHULL BOAT

(71) Applicant: Quadratoon Company LLC, Farmington, MO (US)

(72) Inventors: Michael Timothy O'Neal, Farmington, MO (US); Blaine Lawson, Fredericktown, MO (US); Michael Thomas Farmer, Edwardsburg, MI (US)

(73) Assignee: Quadratoon Company LLC, Farmington, MO (US)

( * ) Notice: Subject to any disclaimer, the term of this patent is extended or adjusted under 35 U.S.C. 154(b) by 0 days.

(21) Appl. No.: 15/472,984

(22) Filed: Mar. 29, 2017

Related U.S. Application Data

(63) Continuation-in-part of application No. 15/062,085, filed on Mar. 5, 2016, now Pat. No. 9,611,008, and a continuation-in-part of application No. 14/102,122, filed on Dec. 10, 2013, now Pat. No. 9,302,740.

(60) Provisional application No. 62/347,375, filed on Jun. 8, 2016, provisional application No. 62/256,630, filed on Nov. 17, 2015, provisional application No. 61/737,245, filed on Dec. 14, 2012.

(51) Int. Cl.

| | |
|---|---|
| ***B63B 27/14*** | (2006.01) |
| ***B63B 1/14*** | (2006.01) |
| ***B63B 7/04*** | (2006.01) |
| ***B63B 35/38*** | (2006.01) |
| ***B63B 3/48*** | (2006.01) |
| *B63B 7/00* | (2006.01) |

(52) U.S. Cl.
CPC ..... *B63B 1/14* (2013.01); *B63B 3/48* (2013.01); *B63B 7/04* (2013.01); *B63B 35/38* (2013.01); *B63B 2001/145* (2013.01); *B63B 2007/006* (2013.01)

(58) Field of Classification Search
CPC ..... B63B 19/08; B63B 2019/083; B63B 2019/086; B63B 2001/145; B63B 35/34
See application file for complete search history.

(56) References Cited

U.S. PATENT DOCUMENTS

| | | | | |
|---|---|---|---|---|
| 2,341,866 A | | 2/1944 | Jackson | |
| 2,669,733 A | | 2/1954 | Picker | |
| 3,508,510 A | | 4/1970 | Frankel | |
| 3,815,541 A | * | 6/1974 | Hansen | B63B 25/006 114/246 |

(Continued)

*Primary Examiner* — Andrew Polay
(74) *Attorney, Agent, or Firm* — Creativenture Law, LLC; Dennis JM Donahue, III

(57) ABSTRACT

An extendable and retractable lower deck for a watercraft is attached to and supported by one or more amidships hulls. The lower deck and hulls slide between an extended position and a stowed position on rails that are secured to the underside frame of the main, upper deck that is supported by abeam hulls. When fully extended, the extendable deck remains attached to the watercraft. A rotatable gate positioned within the lower hull can be used for improved accessibility to and from the water; the gate is stowed when its distal end is in the raised position and is deployed when its distal end extends below the bottom side of the hull into the water in the lowered position. Laterally expandable panels in the lower deck provide increased width, and other accessories used with the watercraft can be contained in one or more storage holds in the amidships hull.

20 Claims, 31 Drawing Sheets

(56) References Cited

U.S. PATENT DOCUMENTS

| | | | | |
|---|---|---|---|---|
| 3,883,910 | A * | 5/1975 | Naylor, III | B63B 27/146<br>114/258 |
| 4,293,967 | A | 10/1981 | Ord | |
| 5,191,854 | A | 3/1993 | Lehmann | |
| 5,537,949 | A | 7/1996 | Blevins | |
| 6,793,039 | B2 | 9/2004 | Schmid, Jr. | |
| 2002/0134290 | A1 | 9/2002 | Armour | |
| 2004/0103839 | A1 | 6/2004 | Fleming | |

* cited by examiner

EXTENDABLE MULTIHULL BOAT

CROSS-REFERENCE TO RELATED APPLICATIONS

This application is a continuation-in-part of U.S. patent application Ser. No. 15/062,085 filed on Mar. 5, 2016 which is a continuation-in-part of U.S. patent application Ser. No. 14/102,122 filed on Dec. 10, 2013 with priority to U.S. Prov. Pat. App. No. 61/737,245 filed on Dec. 14, 2012 and which also claims priority from U.S. Prov. Pat. App. No. 62/256,630 filed on Nov. 17, 2015, and this application also claims priority from U.S. Prov. Pat. App. Ser. No. 62/347,375 filed on Jun. 8, 2016, all of which are incorporated by reference.

STATEMENT REGARDING FEDERALLY SPONSORED RESEARCH

Not Applicable.

APPENDIX

Not Applicable.

BACKGROUND OF THE INVENTION

Field of the Invention

The present invention relates to multihull boats, and more particularly to multihull boats with an extendable platform.

Related Art

There have been many alternative designs that seek to increase the deck space for watercraft on pontoons, including laterally extending decks and longitudinally extending decks. When extending the deck space longitudinally using a ramp, many prior art ramps do not provide any buoyancy to the section of the ramp being extended and others may have negligible buoyancy and slope downward and dip to near water level or at the water level, allowing sections of the deck to be splashed and get wet. Further, such ramps are unstable, particularly in rough weather or choppy water.

The present invention provides an increase in deck space by extending a lower deck longitudinally, while also providing additional longitudinal buoyancy that maintains the elevation of the lower deck above the surface of the water in a near parallel arrangement to the upper deck and avoiding the sloping of the lower deck to water level. The increased buoyancy for the lower deck compensates for the increased structure being supported, which stabilizes the lower deck, even in rough waters. The extended space does not slope toward the water, providing a stable, safe surface to sit, walk or stand.

There are a number of different designs for boats with longitudinally extending decks. As an example of a longitudinally extending deck with a flotation device, U.S. Pat. No. 6,868,799 discloses an extendable ramp with a small cylindrical float located at the end of the ramp. The ramp slopes toward the water and the end of the ramp is essentially level with the water. This patent clearly teaches away from the present invention that provides longitudinal buoyancy to lift the deck and provide stability. As an example of a longitudinally extending deck without any flotation device, U.S. Pat. No. 8,056,496 discloses an extendable deck for a pontoon boat that is stowed under the main deck. The extendable deck has no flotation devices attached, but is levered from the bow of the boat. As the deck is extended beyond its half retracted position, the end of the floating deck begins sloping down and the deck designed to require support by a beach or a boat dock when it is fully extended. This patent likewise teaches away from the claimed invention having longitudinal buoyancy and its resulting stability and safety.

None of the prior art references discloses a secondary deck that is buoyantly supported by pontoons or any other flotation device when the secondary deck is stowed beneath the main deck to which the secondary deck is slidably connected. In addition to providing extra deck space, a secondary deck that has its own buoyant support that is operative when the deck is stowed and when the deck is extended can provide increased stability to the watercraft while maintaining the loading capacity of the watercraft. Known watercraft that merely add slidable planks, ramps or decks which do not offset the weight of these features with an increase in the buoyancy of the watercraft necessarily increase the total weight and therefore reduce the loading capacity of the watercraft. When a float on a ramp is only operable when the ramp is deployed, there is no increase in the buoyancy of the watercraft when the ramp is stowed and this can reduce the stability of the watercraft if the ramp is added to an existing watercraft design. Even if the abeam pontoons are sized larger to accommodate the addition of a ramp, the extension of a ramp that is not supported while it is stowed will necessarily produce a cantilevering effect that will increase the stress on the main deck structure and will also change the boat's attitude in the water while the ramp is cantilevered.

There are also a number of multihull boat designs in which a smaller boat fits between the pontoons or other abeam hull structures of a larger boat, and the smaller boat is secured to the larger boat through various releasable connections. These designs have different configurations and arrangements of the smaller boat and the larger boat, with some smaller boats providing the propulsion for the larger boat while in other cases the larger boat has its own propulsion, and the smaller boat may have propulsion or not In the various alternative designs, the smaller boat may be secured through connections at either the stern or the bow of the larger boat. When the smaller boat is secured at the stern of the larger boat, the larger boat could have a frame, telescoping legs or other structure that extends and retracts in slide retainers or other brackets and releasably connects to the smaller boat, such as disclosed in U.S. Pat. Nos. 3,815,541 and 7,987,803. The smaller boat may maintain its waterline when it is connected to the larger boat, such as in the '803 patent, or it be partially lifted out of the water, such as in U.S. Pat. Nos. 3,659,546 and 3,815,541, or lifted entirely out of the water, such as in U.S. Pat. App. Pub. No. 2014/0041569. Regardless of the particular configurations and arrangements of such smaller boats secured between the abeam hulls of a larger boat, all of these designs are similar in their use of releasable connections between the smaller and larger boats. The releasable connections between the smaller and larger boats are necessary for launching the smaller boat. Accordingly, although the smaller boat has its own deck and hull apart from the deck of the larger boat, there are no permanent fasteners, stops or other fixed connections that prevent the smaller boat from being deployed because any such connections would defeat the intended purpose of the smaller boat to be launched and separate from the larger boat.

In addition to increasing the extra deck space of a boat, it would also be beneficial to increase the storage space for items that enhance the overall enjoyment of the boat. Known watercraft that merely add slidable planks, ramps or decks certainly improve the functionality of the boat, but these additional features cannot increase the storage space, and they are limited in their usage. The combination of a smaller boat with a larger boat can allow for additional storage space, but the items that can be stowed in the smaller boat are limited if the smaller boat is going to maintain its intended purpose of being launched from the larger boat. Additionally, in order for the storage space in the smaller boat to be usable, it should be readily accessible. Accordingly, the smaller boat does not provide any significant increase in the usable storage space for items that would enhance the overall enjoyment of the boat.

SUMMARY OF THE INVENTION

An upper deck is supported on a bottom side by one or more abeam pontoons or a pier structure. A lower deck is located beneath the upper deck, and the decks are slidably connected through a pair of longitudinally elongated guides that are fixedly connected to the bottom side of the upper deck between the abeam pontoons or the piers. The lower deck and has a stowed position underneath the upper deck and an extended position out from underneath the upper deck. Longitudinal buoyancy is provided the lower deck by means of one or more amidships pontoons or a monohull.

In one aspect of the present invention, the lower deck and its monohull provide additional usable storage space as well as increased deck space. To provide additional usable storage space, one or more panels in the lower deck can be opened when the deck is in its extended position to permit access to one or more storage containers that are attached to and fitted within the frame between the pair of amidships pontoons or abeam of a single center pontoon or in an internal storage hold formed between the lower deck and a monohull.

In another aspect of the present invention, an accessory that is contained in the storage space beneath the lower deck is extracted and installed on the deck or is raised from its folded configuration on the hull or is uncovered for access from the open deck or is deployable from a space on the lower deck or its storage hold and aids in off shore entry. Example accessories include a gate, pool liner insert, a hot tub liner insert, a slide and ladder assembly, a seat and mounting bracket assembly, a volleyball net and pole assembly, an umbrella and pole assembly, a hammock and stand assembly, a seat lift, and an expandable deck insert.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings which are described in the detailed description below.

DETAILED DESCRIPTION OF THE PREFERRED EMBODIMENTS

Figure 1A:
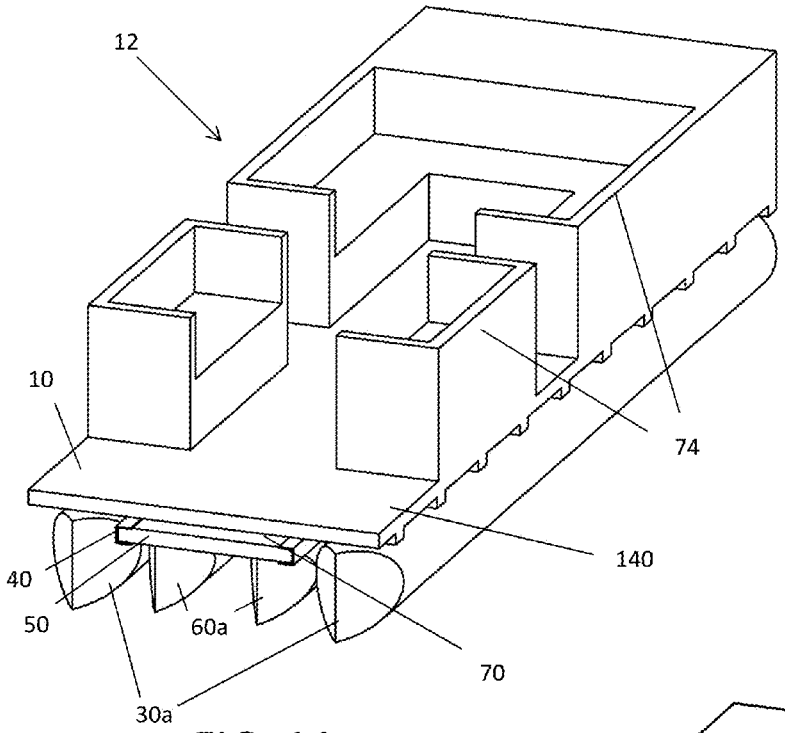
FIGS. 1A and 1B are downward isometric views of an embodiment of the pontoon boat of the present invention having two amidships pontoons in the stowed and extended positions, respectively.
Figure 1B:
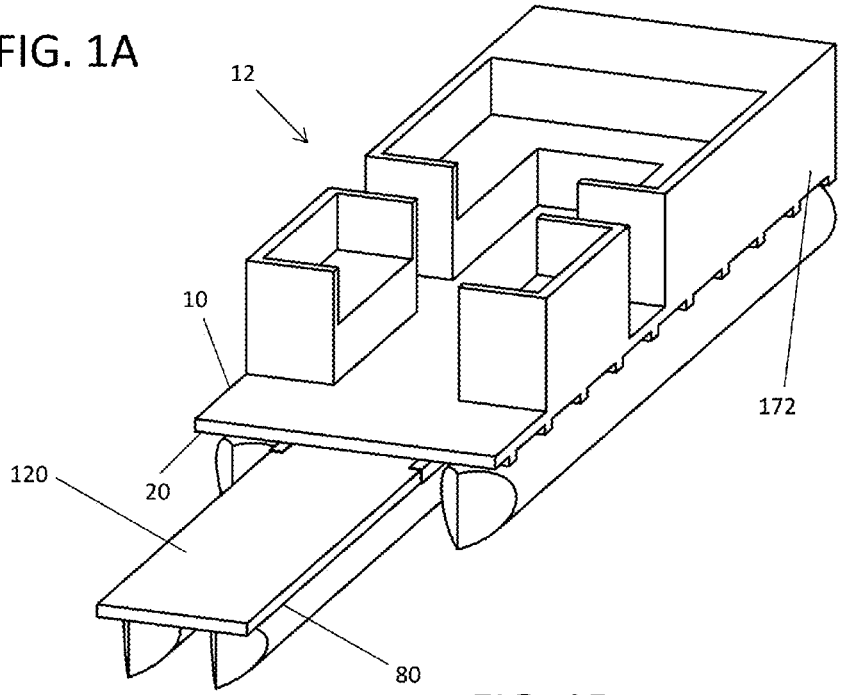

The following description of the preferred embodiment(s) is merely exemplary in nature and is in no way intended to limit the invention, its application, or uses.

As generally shown in FIGS. 1A, 1B, 2A, 2B, and 2C, a multihull boat 12 has a main, upper deck 10 and a secondary, lower deck 50 and a pair of elongated guide rails 40 connecting the secondary deck to the main deck in a sliding arrangement. The upper deck is supported on its underside frame 20 by a pair of abeam pontoons 30 or other buoyancy devices that extend longitudinally along the length of the upper deck. The guide rails are preferably fixed to the underside frame 20 of the upper deck and are generally parallel to the longitudinally elongated abeam pontoons 30. The lower deck is preferably supported by at least one amidships pontoon 60 that is longitudinally arranged 60' and positioned between the abeam pontoons 30. Depending on the particular application of the multihull boat, two amidships pontoons 60 may be used to support the lower deck, or the lower deck may be supported by the single pontoon or a monohull. The amidships pontoons are preferably at least half as long as the lower deck. Preferably, they are at least 75% as long as the lower deck, and in the preferred embodiment they have the same length as the lower deck. The amidships pontoon or pontoons 60 provide longitudinal buoyancy to the lower deck so that the extended deck is elevated above the level of the water and is stabilized against rough or choppy water during inclement weather. In one embodiment, seats 74 are mounted on the upper deck.

Figures 2A, 2B, 2C:
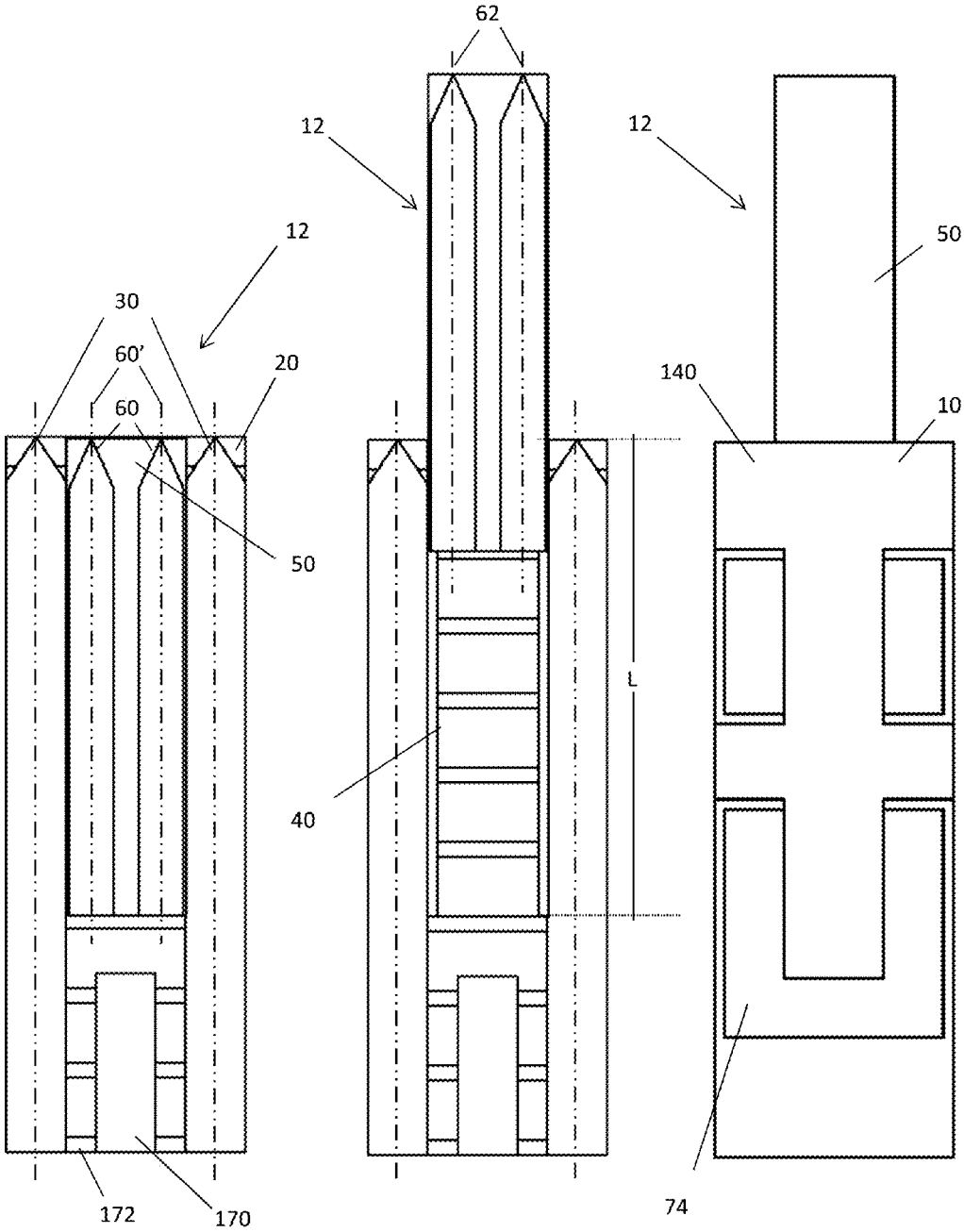
FIGS. 2A and 2B are bottom plan views of the invention shown in FIGS. 1A and 1B, respectively.
FIG. 2C is a top plan view of the invention shown in FIGS. 1B and 2B.

As shown in FIGS. 1A and 2A, in its stowed or retracted position 70, the secondary deck 50 is located substantially beneath the main deck 10, and its pair of amidships pontoons 60*a* extend longitudinally between the pair of abeam pontoons 30*a* beneath the lower deck and the upper deck. In its extended position 80, shown in FIGS. 1A and 2B, the lower deck and the amidships pontoons slide out on the guides 40 to extend longitudinally out from the upper deck's bow and the abeam pontoons. The increased deck space provided by the extension of the secondary deck 50 is shown in FIG. 2C.

Figure 3A:
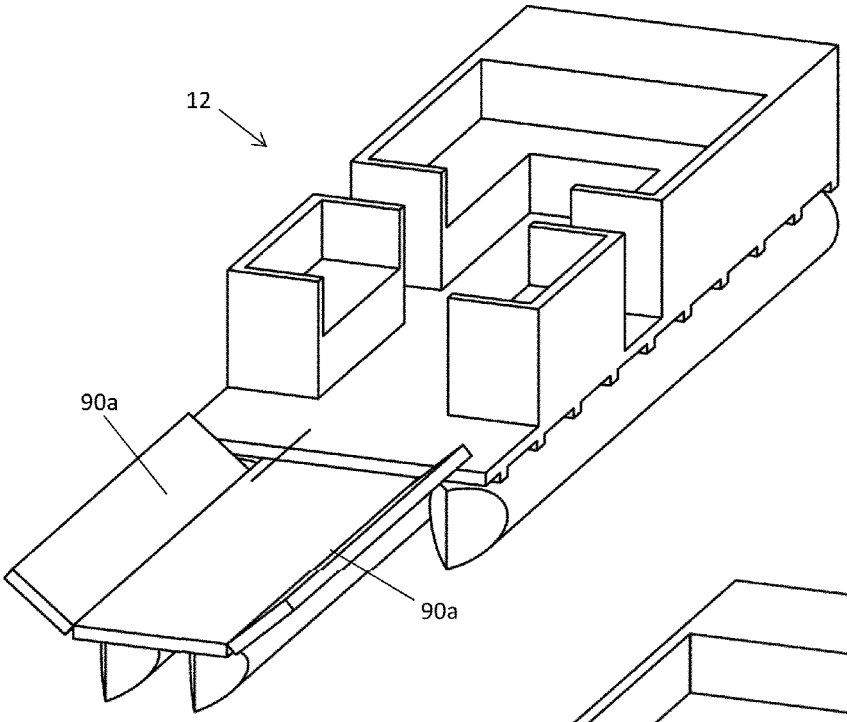
FIGS. 3A and 3B are downward isometric views of an embodiment of the present invention in the extended position with foldable wings partially and fully unfolded, respectively.
Figure 3B:
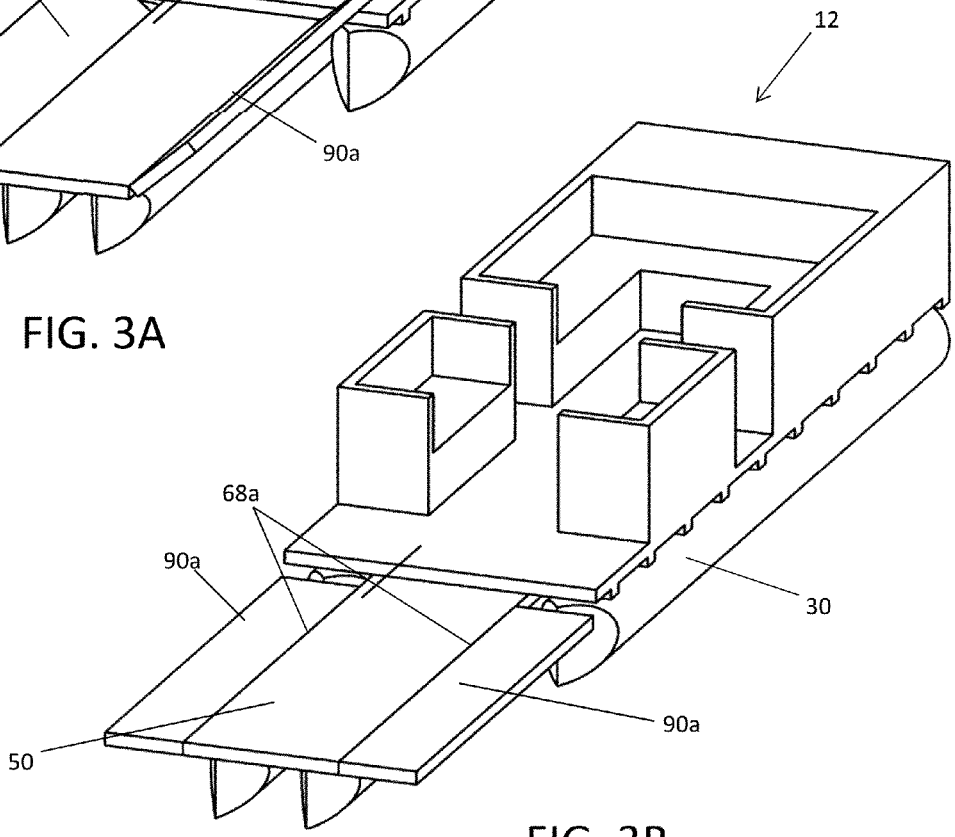

As shown in FIGS. 3A and 3B, the lower deck 50 can have at least one flip-out or otherwise laterally expandable deck surface 90, such as a foldable wing 90*a*, a pivoting platform 90*b*, or a sliding surface 90*c* that extends along both sides of the lower deck. Depending on the particular type of laterally expandable deck surface 90 that is incorporated into the lower deck 50, different lateral extensions 68 are used to support the portion of the deck surface that is cantilevered over the sides of the lower deck. Generally, the laterally expandable deck surface has a pair of laterally reciprocating structural panels 90' that move between an expanded or open position and a contracted or closed position. In one embodiment, the lower deck has two foldable wings 90*a* as shown in FIGS. 3A and 3B. The wings can be laterally folded over the lower deck in a closed position so that the wings are located between the lower deck and the upper deck when the lower deck is stowed. The wings can be rotated out into an open position after the lower deck is extended to increase the lower deck space by 50% or more. Deck extensions, such as the flip-out wings, may be applied by folding out additional decking material, running parallel on one or both sides partially or the full length of the existing lower deck. The foldable extensions can be supported and stabilized by protective coated brackets 68*a*, hinges, or cables.

It will also be appreciated that it is possible that the side extensions may be further supported by an optional truss that may also be extended from a stowed position under the upper deck. An example cantilevered truss system would be a series of sliders that extend from the frame 52 beneath the lower deck 50 similar to lopper supports of hinged secretary desks (drop front desks). In one embodiment the wings are manually opened and closed, although it will be appreciated that an actuation system could be used to mechanize the folding and unfolding operations. As with some secretary desks, the sliders could automatically extend from the frame through gears or levers that connect the sliders to the foldable wings 90*a* so the slider supports could automatically extend and retract when the wings are opened and closed, respectively, regardless of whether the folding/unfolding operations are manual or mechanized.

Figure 3C:
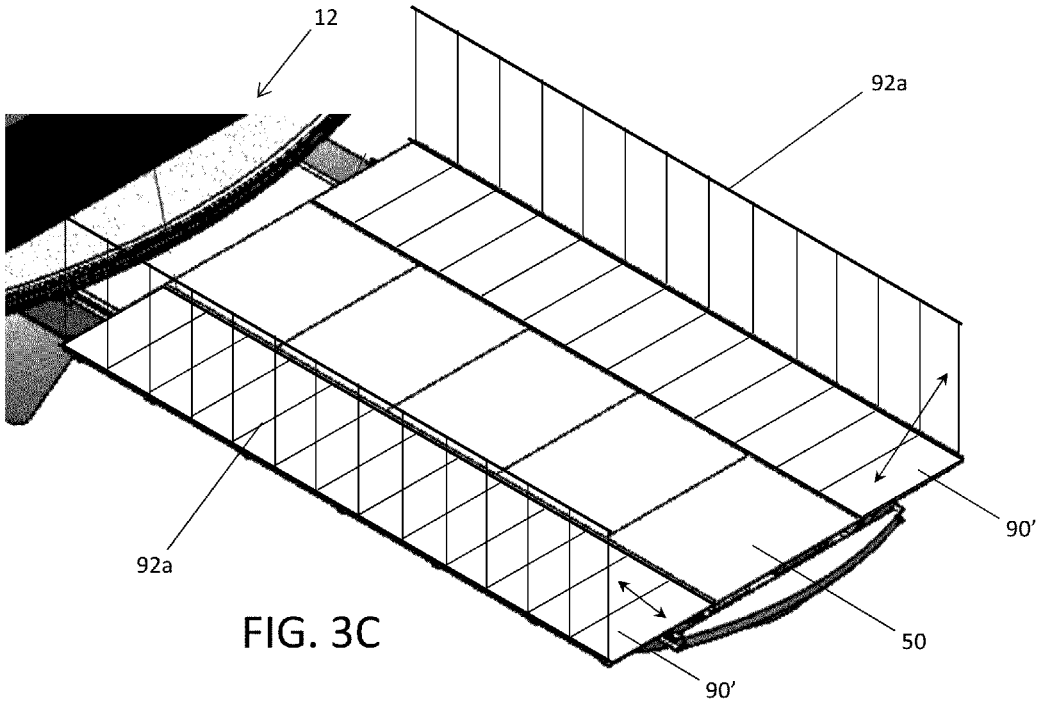
FIGS. 3C and 3D are downward isometric views of an embodiment of the present invention in the extended position with foldable and retractable handrails.
Figure 3D:
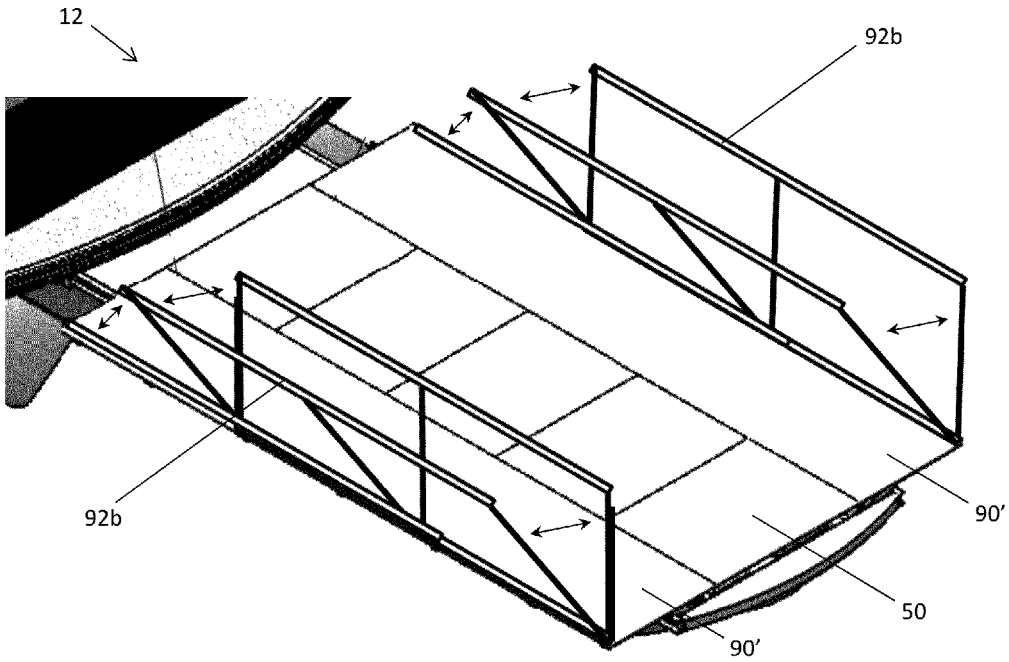

Additionally, the foldable structures could be railings 92, such as retractable or otherwise foldable handrails. It is also possible that the ends of the expandable panels may include foldable railings that can be unfolded when the wings are unfolded. Examples of retractable handrails 92*a* and foldable handrails 92*b* with laterally expandable deck surfaces 90 are shown in FIGS. 3C and 3D, respectively.

Figure 4A:
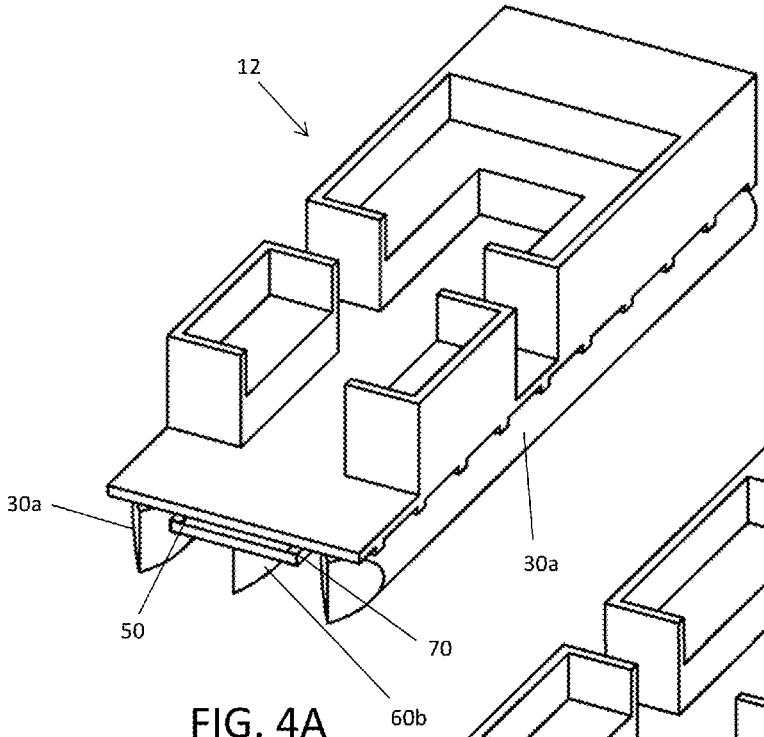
FIGS. 4A and 4B are downward isometric views of an embodiment of the pontoon boat having a single amidships pontoon in the stowed and extended positions, respectively.
Figure 4B:
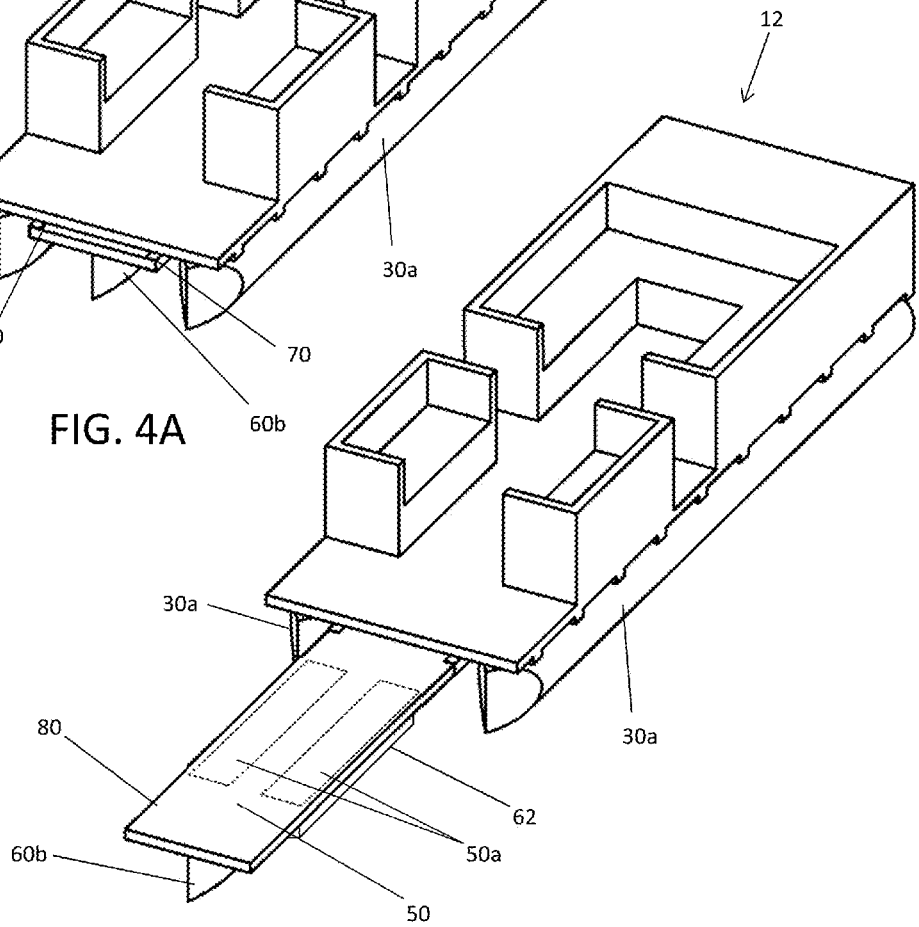
Figure 9A:
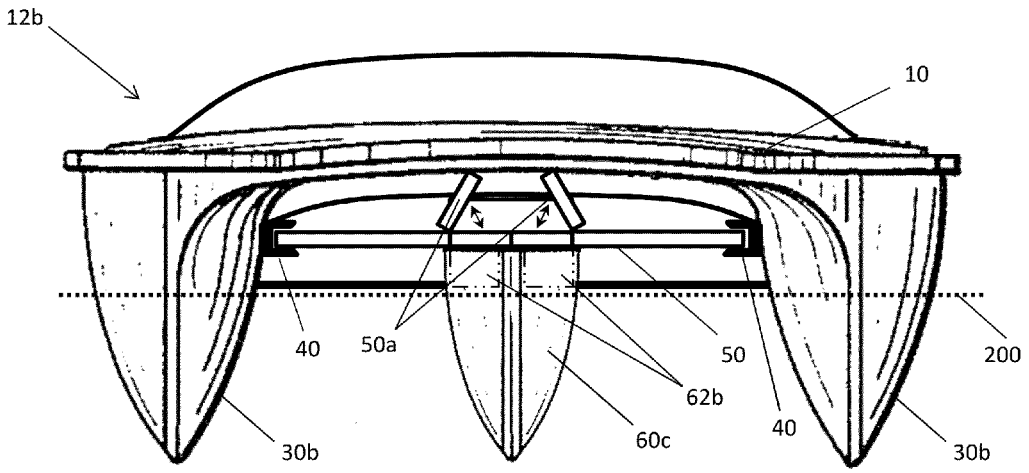
FIG. 9A is a bow end view of an embodiment of the catamaran boat of the present invention.
Figure 9B:
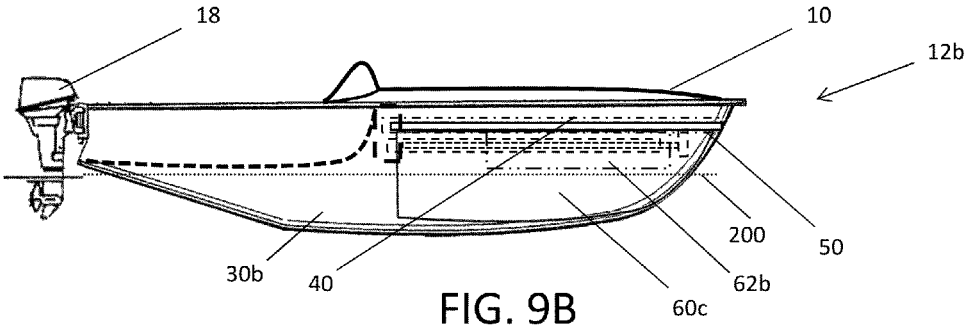
FIGS. 9B and 9C are starboard side views of the boat shown in FIG. 9A in the stowed and extended positions, respectively.
Figure 9C:
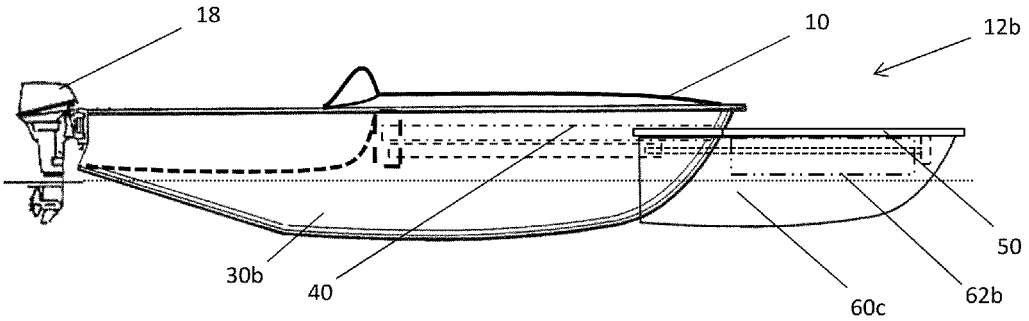
Figure 10A:
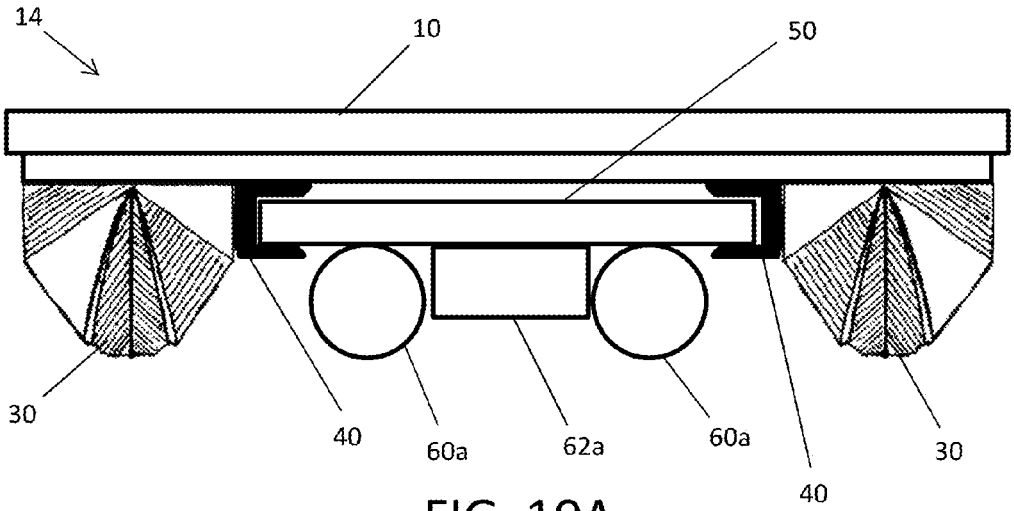
FIGS. 10A and 10B are front views of an embodiment of the main deck and secondary deck of the present invention.
Figure 10B:
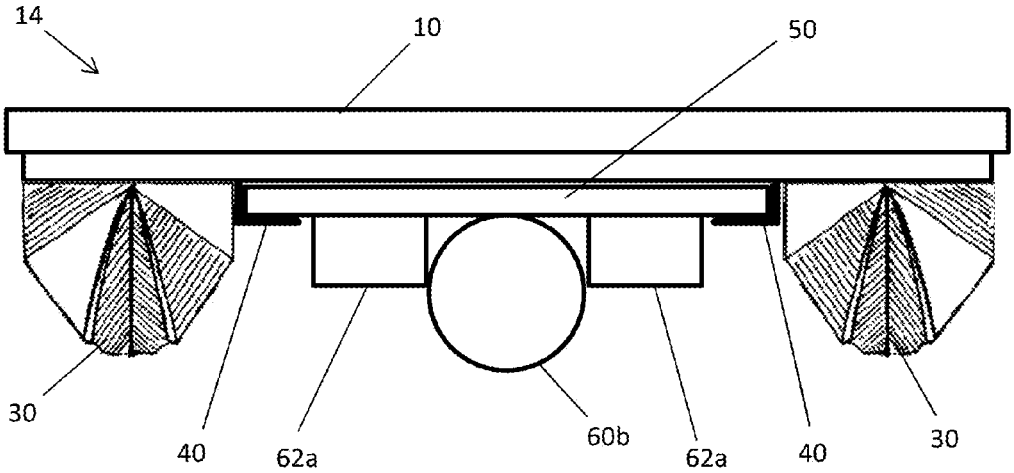

The increased buoyancy and stability of multiple amidships pontoons for the lower deck may be particularly beneficial for the foldable wings' additional weight and cantilevered structure. However, as shown in FIGS. 4A and 4B, it is also possible to use a single amidships pontoon 60*b* to support the lower deck 50. It will be appreciated that the size of the single or multiple amidships pontoons may be the same size as the abeam pontoons 30*a* or they can be a different size and possibly a different shape to better support the lower deck and to fit within the space below the upper deck. For example, as shown in FIG. 10A, a pair of pontoons 60*a* fit well in the space beneath the lower deck, whereas a single larger pontoon 60*b* could fit in the space beneath another lower deck, such as shown in FIG. 10B. Additionally, FIGS. 9 and 12 show examples of different monohulls 60*c* supporting the lower deck 50. These embodiments also illustrate how the extendable deck 50 with one or more hulls 60 can provide additional storage space 62. In particular, the lower deck 50 can have access panels 50*a* that can be opened when the deck is in its extended position. According to the various embodiments, one or more storage containers 62*a* may be attached to and fitted within the lower deck's frame 52 between the pair of amidships pontoons 60*a* or abeam of a centerline pontoon 60*b* or monohull 60*c* or in an internal storage hold 62*b* formed within the monohull.

Figure 5A:
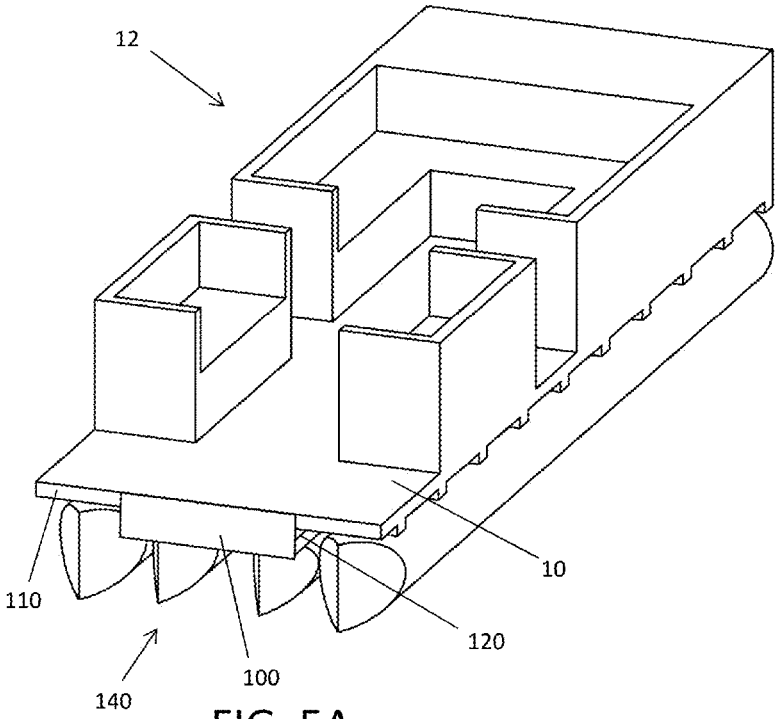
FIG. 5A is a downward isometric view of an embodiment of the pontoon boat of the present invention in the retracted position with a hinge plate.
Figure 5B:
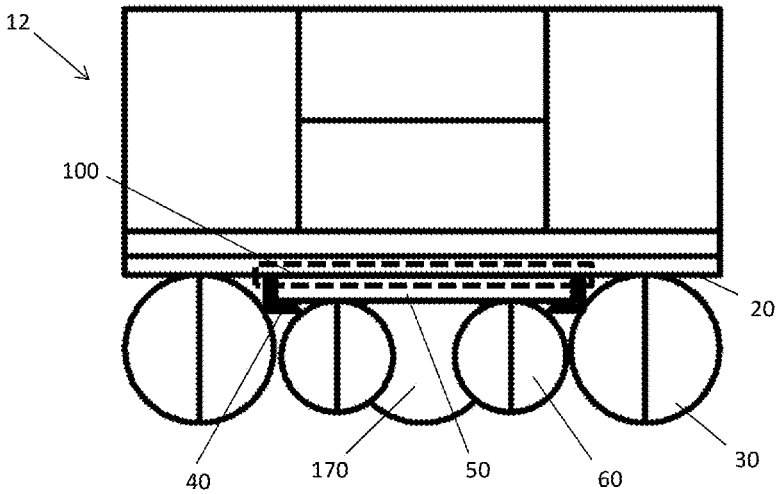
FIG. 5B is a bow end view of the boat shown in FIG. 5A.

As shown in FIGS. 5A and 5B, the upper deck 10 may also have a rotatable hinge plate 100 extending from the front face of the upper deck 110 on its bow 140 to the top side 120 of the lower deck's surface. The hinge plate is a safety protection feature which helps to ensure the safety of passengers from the different deck levels when the lower deck is extended as well as when it is moving between its stowed and extended positions. The dimensions of the hinge plate could be three (3) or more inches wide and preferably spans the width of the lower deck. As another safety feature, the lower deck preferably has white anchor lights mounted to its front to ensure safe use at night when the lower deck is extended. Other features may be added such to the lower deck, such as ladders, cup holders, spring boards, table bases and other accessories that are typically found on pleasure vessels and watercraft.

Figure 6:
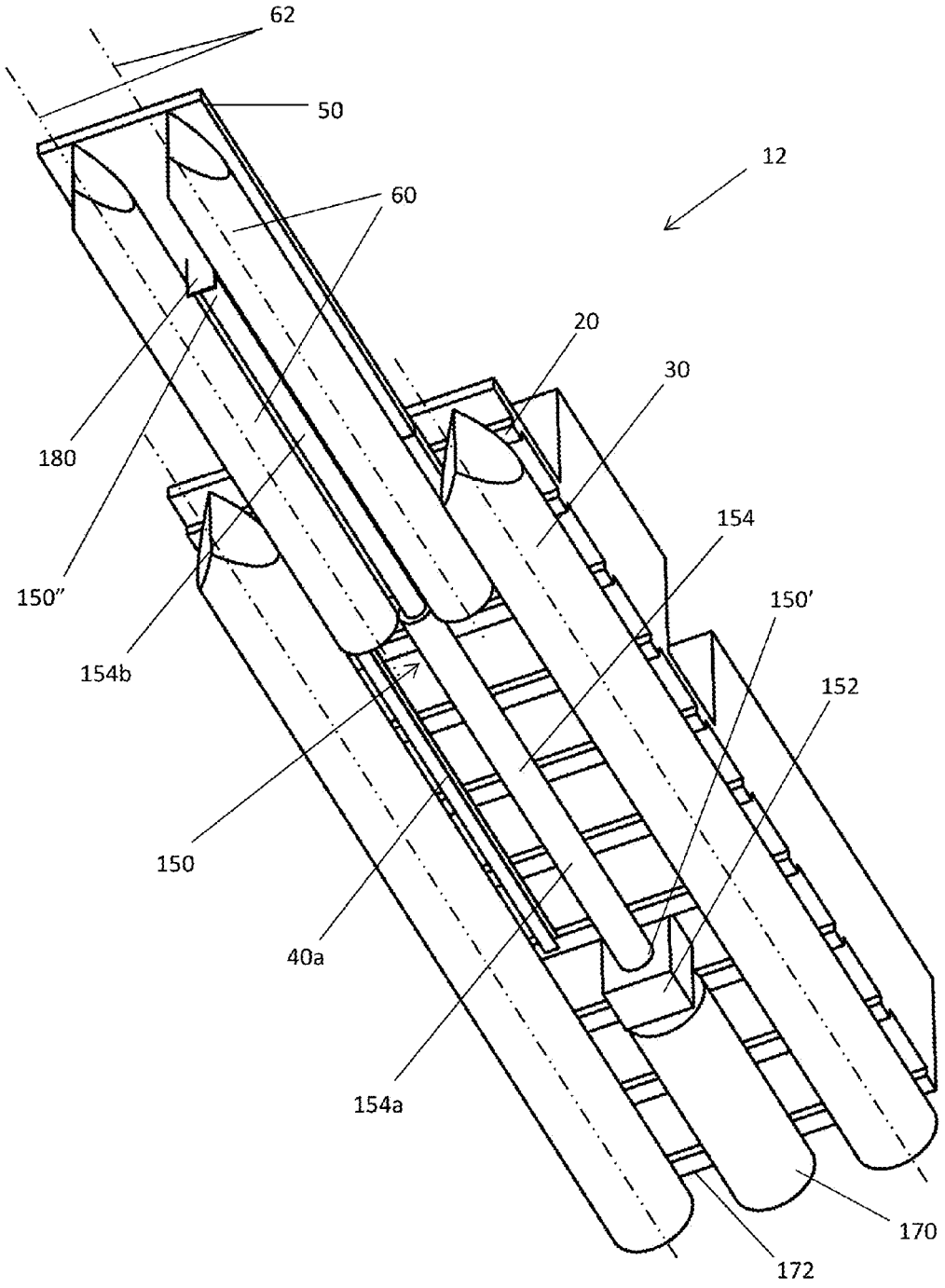
FIG. 6 is an upward isometric view of an embodiment of the pontoon boat of the present invention in the extended position with an actuator system.

The guide rails 40 generally described above are preferably formed from a pair of C-channels 40*a* as shown in FIGS. 1A and 6 that are permanently mounted on the underside frame 20 of the main deck 10 between the flotation devices of a support structure. The C-channels are mounted parallel to each other and the abeam pontoons 30 with their open sides facing amidships toward each other. The C-channel spans the length of the lower deck. The channel supports the lower deck and provides a sliding base for extending and retracting the lower deck. It will be appreciated that the guide can be a c-channel, an f-channel, or any other sliding channel, track, rail or other guide that is known to be used for holding and sliding one structure relative to another structure. Generally, the guide rails 40 have a web portion and at least one flange projecting perpendicularly from the web portion, and the length (L) of the guide rails can be longer than the length of the lower deck. A wide range of existing sliding mechanisms may work with the present invention, such as mechanisms described in U.S. Pat. Nos. 6,868,799, 5,085,165, 6,003,458, 6,874,440 and 7,028,632 which are hereby incorporated herein by reference.

Figure 7:
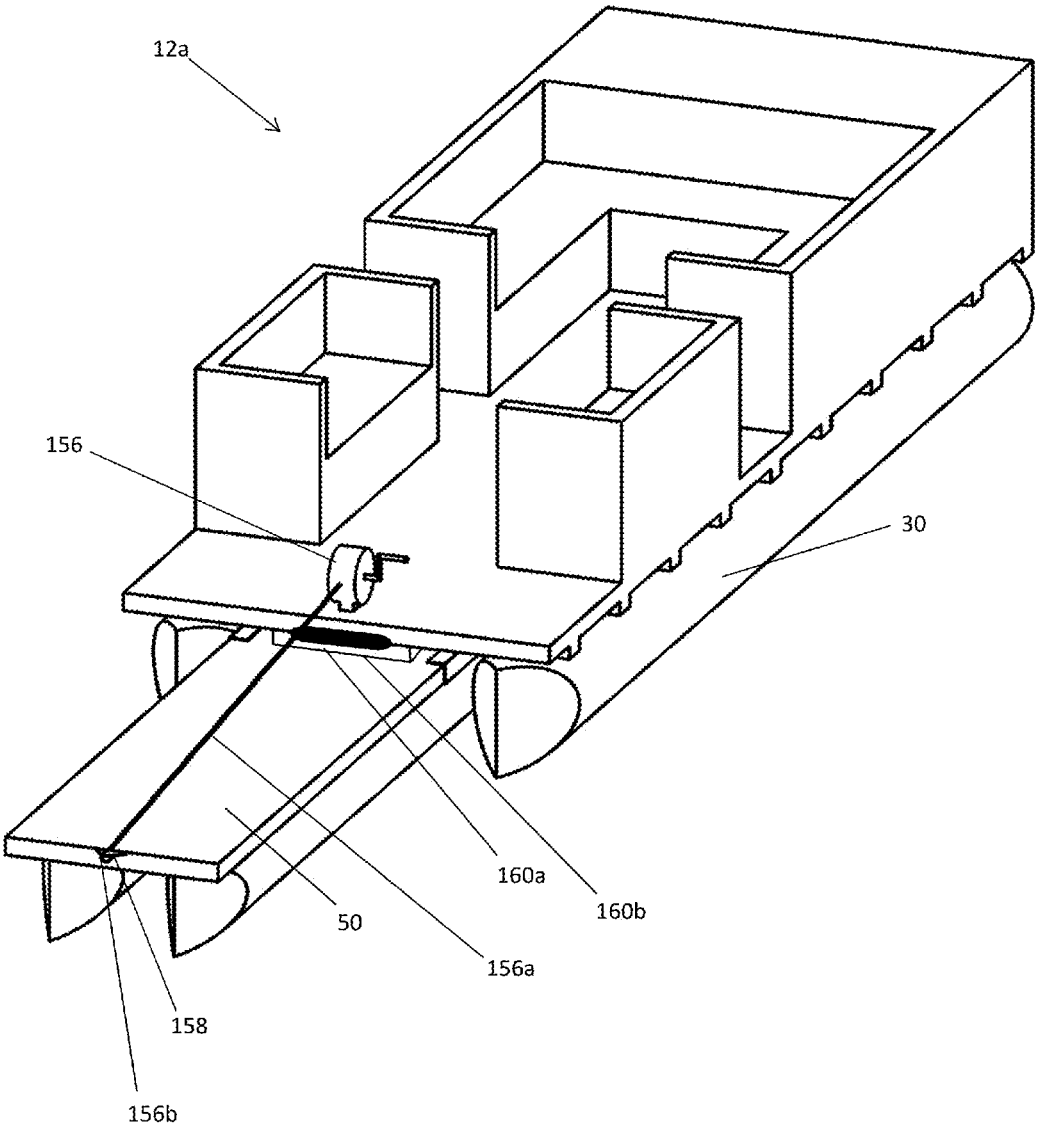
FIG. 7 is a downward isometric view of an embodiment of the pontoon boat of the present invention in the extended position with a manual winch.

Just as there are several options to connect the lower deck to the upper deck through various guide systems, there are different ways to actuate the lower deck and move it between its retracted and extended positions. Alternative actuator systems for moving the lower deck 50 relative to the upper deck 10 are shown in FIGS. 6 and 7 and may include various types of linear actuators 150, such as a screw and nut arrangement, a ram cylinder, a pneumatic cylinder, a hydraulic cylinder or a track gear. Generally, an electric motor 152 is used to power the actuator. For example a 12-volt motor with a forward and reverse drive can be used, and the motor can also have a neutral position. In one embodiment, the motor is mounted in front of the motor mount 170 at the stern 172 of the boat, between the abeam pontoons 30. In one embodiment, the screw can be rotated to force the threaded nut to move within a channel under either of the decks or an entire channel mounted under the deck can surround the screw.

In a preferred embodiment, the actuator 150 uses ram power, a telescoping hydraulic linear actuator 154 can have a fixed outer cylinder 154*a* and an inner rod 154*b* that extends from the outer cylinder. The outer cylinder is fixed to the upper deck structure at the actuator's aft end 150', such as through attachment to the motor housing that is either directly connected to the upper deck or can be indirectly connected to the upper deck through an actuator bracket that is attached to the aft end section of the guide rails as described in detail below with reference to FIG. 11. The forward end of the inner rod at the actuator's forward end 150" is connected to a mount 180 that is fixedly attached to the underside frame 52 of the lower deck. For a powered track/gear option, a notched track can be attached beneath the lower deck and extend back to a gear mounted to the motor. For example, the gear actuator could be mounted to the underside frame 20 of the main deck structure adjacent to the side of the lower deck, and the gear would operate on a track that is mounted to the side of the lower deck. Whichever actuator system is used, it can be operated with a switch on the console or control panel of the watercraft, selecting between the forward, reverse and neutral operations. It will also be appreciated that it is possible to manually extend the secondary deck from its stowed position and then manually retract and lock the secondary deck in its stowed position.

In the preferred operation of the present invention, the lower deck is not designed with sufficient structural strength to accommodate powered travel along the water when the lower deck is fully or partially extended. Accordingly, there could be a propulsion power kill switch which prevents the watercraft's motor from being started while the lower deck is moved from its stowed position. It will also be appreciated that there could be a mechanical failure in the actuator system which prevents the powered retraction of the lower deck into its stowed position. Therefore, a manual actuator could also be provided with the secondary deck. For example, as shown in FIG. 7, in the event of a failure of the powered actuator system, a manual hand crank winch 156 with a winch cable 156*a* or strap and a hook 156*b* at the end may be latched to a receiver bracket 158 attached to the lower deck and manually operated to retract the lower deck. As particularly shown in FIG. 7, the hook engages a U-bolt at the bow of the lower deck. The actuator operation can be switched to neutral to manually crank in the lower deck, and there may also be an override of the motor kill switch. When the lower deck is in its fully extended position, a portion of the lower deck will remain under the upper deck and secured between the guide rails to ensure the stability and structural integrity of the watercraft at its main stress points.

A limit switch on the actuator 150 can prevent the lower deck from extending past the limit of its fully extended position 80. Additionally, there can be a failsafe physical hard stop 160 apart from the actuator that prevents the lower deck 50 and its hull 60 from breaking the their connections to the actuator and to the upper deck 10 and its pontoons 30. For example in the embodiment shown in FIG. 7, a block 160*a* is connected to the lower deck 50. The block engages and cannot extend past a stop bracket 160*b* fixed to the main deck 10 either at the fully extended position or at some failsafe position in the event that the lower deck 50 and its hull 60 accidentally move past the intended fully extended position. Another type of hard stop 160 could be used within the guide rails 40 and is discussed below with reference to FIG. 11. It will be appreciated that the hard stop devices can be used alone or together to ensure that the lower deck will not exceed its limits and to prevent the lower deck from breaking free from its connections to the actuator and the upper deck. In the preferred mode of operation, the actuator maintains the limits of longitudinal travel for the lower deck and its hull, between the stowed position 70 and the fully extended position 80. Just as there can be the hard stop 160 that prevents to the lower deck from breaking free from the actuator, it will also be appreciated that a physical locking mechanism could be used to hold the lower deck in its stowed position in addition to the connection to the actuator.

Figure 8A:
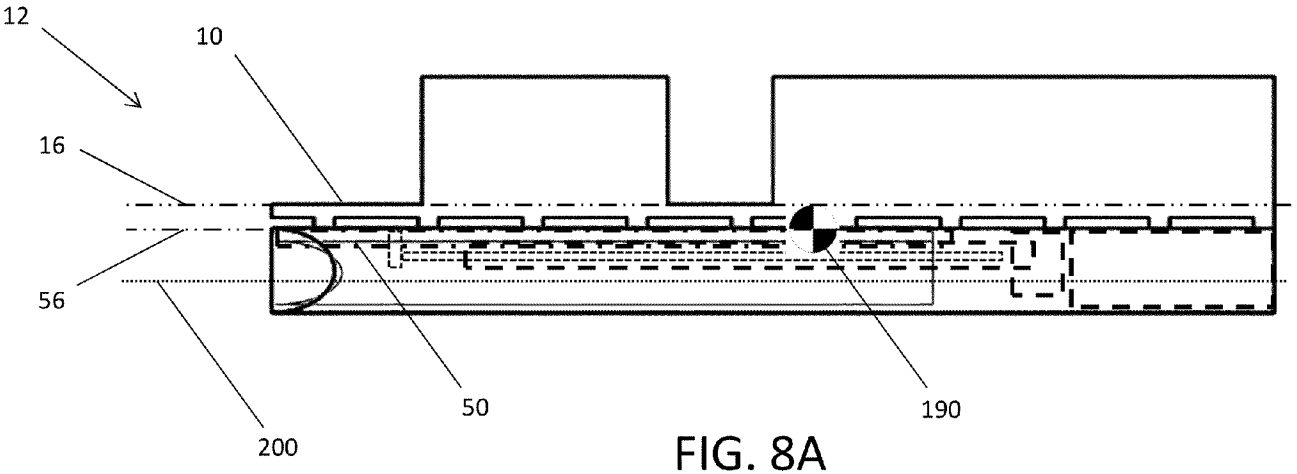
FIGS. 8A and 8B are port side views of an embodiment of the pontoon boat of the present invention in the stowed and extended positions, respectively.
Figure 8B:
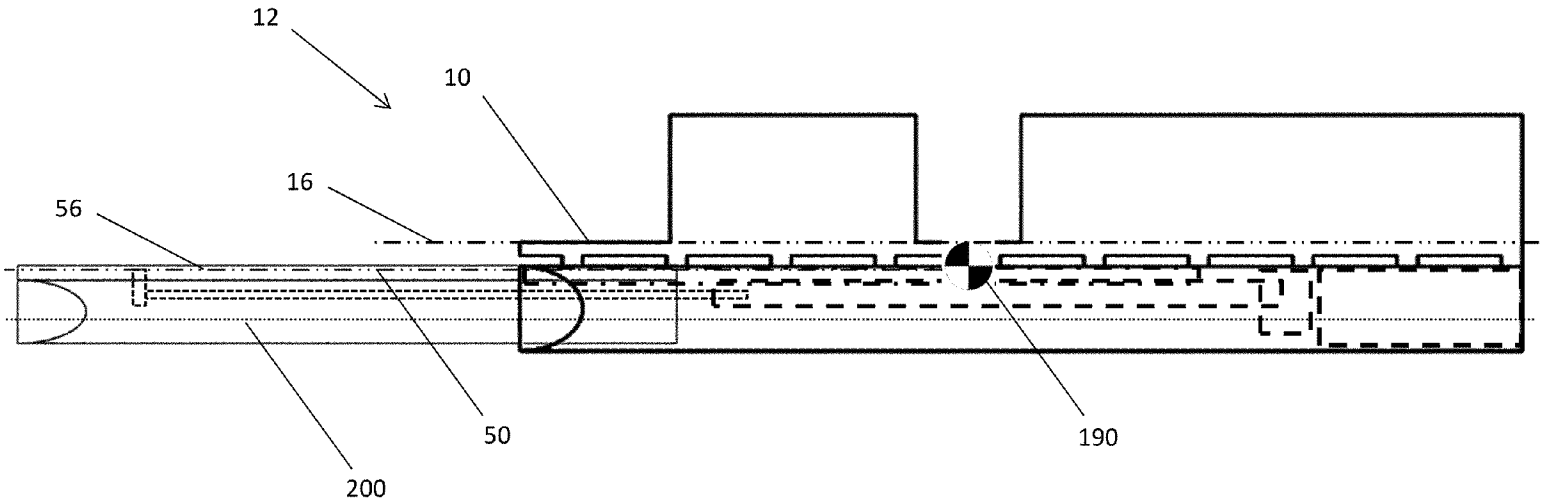

The overall buoyancy of the watercraft 12 does not vary depending on whether the lower deck retracted in its stowed position beneath the upper deck or is extended out from the upper deck, but as shown in FIGS. 8A and 8B the center of buoyancy and the center of gravity of the watercraft 190 shift towards the bow 140 of the watercraft as the lower deck is extended. Accordingly, the size and shape of the amidships pontoons are preferably selected to buoyantly support the entire weight of the lower deck at approximately the same level above the waterline as the level of the guide rails. When there is sufficient buoyancy in the amidships pontoons to support the lower deck at approximately the same level above the waterline 200 as the guide rails, the lower deck is buoyantly neutral to the overall buoyancy of the watercraft so there is no variation in the watercraft's attitude when the lower deck is moved between the stowed and extended positions. When there is slightly less buoyancy in the amidships pontoons than the weight of the lower deck, the change in the location of the center of gravity would move forward slightly farther than the center of buoyancy when the lower deck is fully extended which could cause the watercraft to assume a slight bow-down attitude as compared to the attitude when the lower deck is stowed. Similarly, the amidships pontoons should not greatly exceed the weight of the lower deck because this could cause a slight bow-up attitude when the lower deck is extended. When the amidships pontoons provide neutral buoyancy relative to the waterline level of the guide rails, the plane 56 of the secondary deck 50 remains substantially horizontal and parallel to the plane 16 of the main deck 10 as it moves from the stowed position to the fully extended position.

According to the present invention, the lower deck and its guide and actuator systems could be specially designed and produced with new watercraft. Alternatively, the lower deck and its accompanying systems could be designed for retrofitting existing watercraft, regardless of the age of the watercraft or the brand of watercraft. By retrofitting existing watercraft, older pontoon boats can be updated for weight capacity, horsepower and other improvements without the expense of an entirely new boat. With a standard size pontoon, there is approximately one hundred pounds (100 lbs) of buoyancy per linear foot of the additional amidships pontoons. For example, an improvement of a standard twenty-four foot (24 ft) pontoon boat 12*a* according to the present invention could add as much as thirty-two hundred pounds (3,200 lbs) of buoyancy to a standard pontoon boat, and a standard tritoon conversion could add as much as one thousand pounds (1,000 lbs) of buoyancy. As discussed above, the increased buoyancy of the amidships pontoons should be at least as much as is required to maintain the weight of the lower deck in approximately the same waterline when it is extended as when it is stowed.

It will be appreciated that the present invention can be used with any multi-deck, multihull watercraft 12 as well as other floating multi-deck platforms and structures 14. An example of a triple-hulled catamaran 12*b*, a trimaran, is shown in FIGS. 9A, 9B and 9C to have an extendable lower deck 50 and center monohull 60*c* between the abeam hulls 30*b*, and an example of a main deck 10 with an extendable lower deck is shown in FIG. 10 for the floating multi-deck platform 14. Accordingly, the flotation devices can be any type of floats that may satisfy a particular design, such as pontoons for a pontoon boat 12*a*, hulls for a catamaran boat, buoys for a house boat, a floating dock, a mooring platform or any other anchored floating raft. With regard to the trimaran, it can be a motor boat with an outboard motor 18 as shown in the illustrations or may be a sailboat. This embodiment also shows a pair of access panels 50*a* in the lower deck 50 that open to a respective pair of storage holds 62*b* formed within the monohull. It will also be appreciated that storage containers could also be attached beneath the lower deck on opposite sides of the monohull with additional corresponding access panels in a manner similar to the embodiments shown in FIGS. 4B and 10B.

With regard to docks 14 in particular, it will be appreciated that the lower deck and its accompanying systems as described herein and recited in the claims can be connected to a floating dock or any other type of a stationary dock, including a permanent dock supported by piers. For a dock on piers, it will be appreciated that there is a space for the lower deck between the piers beneath the bottom of the dock and the water under the dock which may vary with tides or the height of a lake. Therefore, the lower deck can have lengths and widths of various sizes to accommodate different upper deck sizes that may be found in house boats, pontoon boats, tritoon boats and any other multihull watercraft or dock.

As shown in the drawings, the bow end of the lower deck and its amidships pontoons are relatively flush with the bow end of the upper deck and the abeam pontoons, respectively, when they are in their retracted positions. However, it will be appreciated that the retracted positions of the lower deck or its amidships pontoons may be slightly recessed from the upper deck and its abeam pontoons. Alternatively, the retracted positions of the lower deck or the amidships pontoons may be slightly extended from the upper deck and the abeam pontoons. The recessed lower deck and pontoon arrangement may be particularly beneficial for permanent docks where owners must comply code restrictions and association restrictions for the size of floating docks and even permanent ground-supported docks, such as the pier dock described above. The slightly extended lower deck and pontoon arrangement could be as much as approximately six inches or more and may be beneficial to improve maneuverability and turning radius of a watercraft.

When the lower deck is in the extended position, the lower deck is elevated above the surface of the water from about 10 to 20 inches. When the lower deck is used, the user is less likely to be splashed by waves. Further, because of the longitudinal buoyancy provided by the amidships pontoons, the lower deck is extremely stable and safe.

Figures 11A, 11B, 11C:
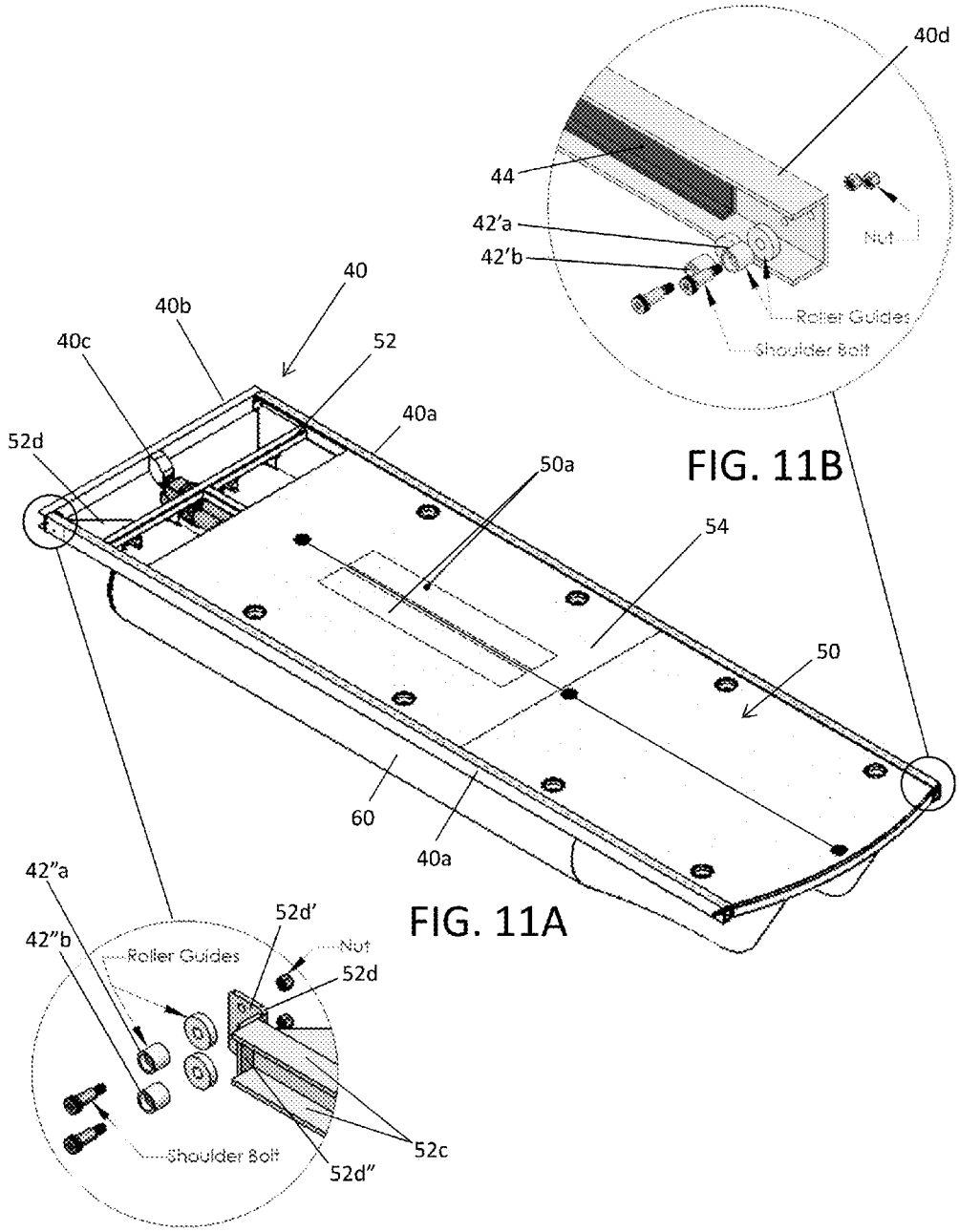
FIGS. 11A-11J illustrate guide rail and deck frame details of the secondary deck.
Figures 11D, 11E, 11F, 11G, 11H, 11I:
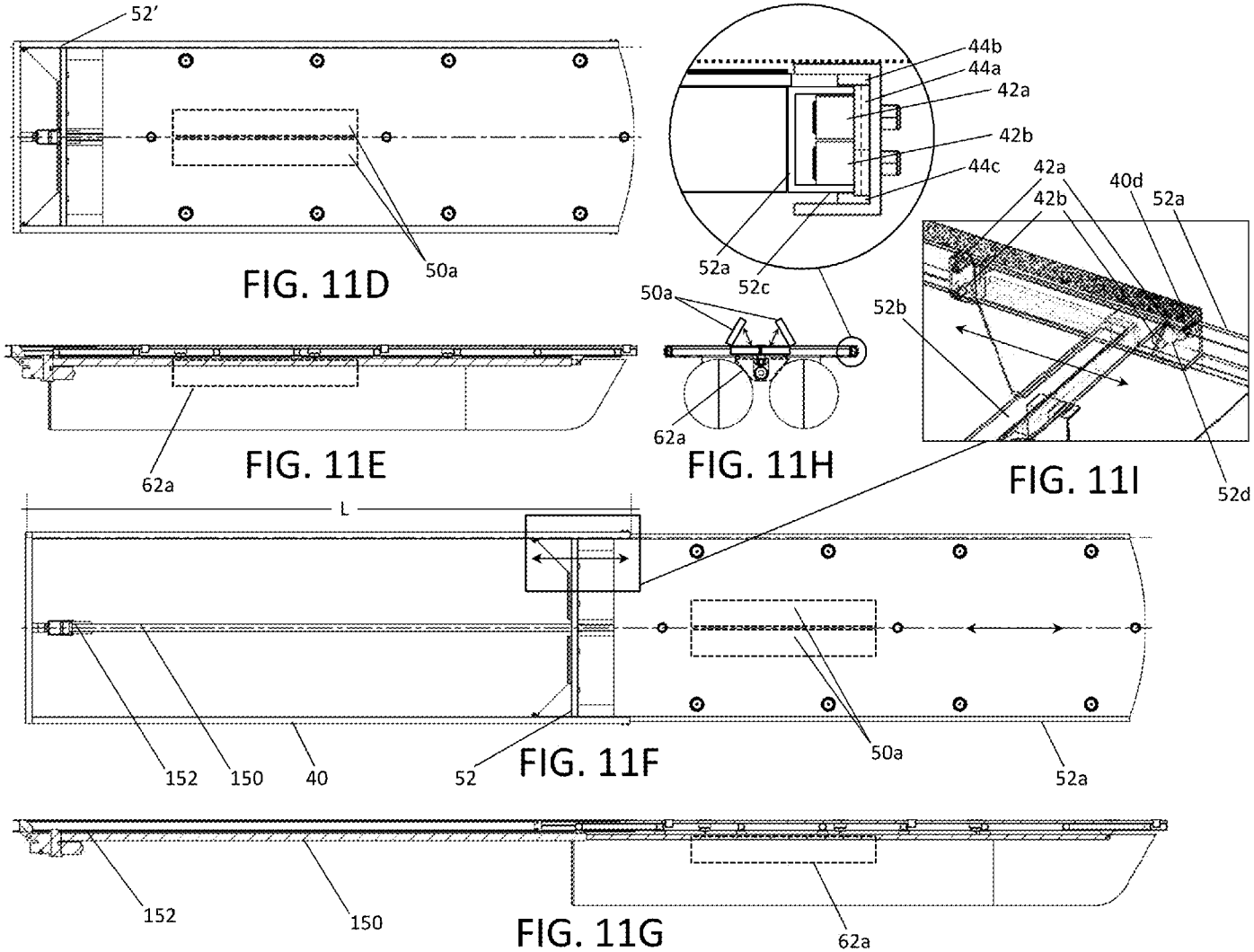
Figure 11J:
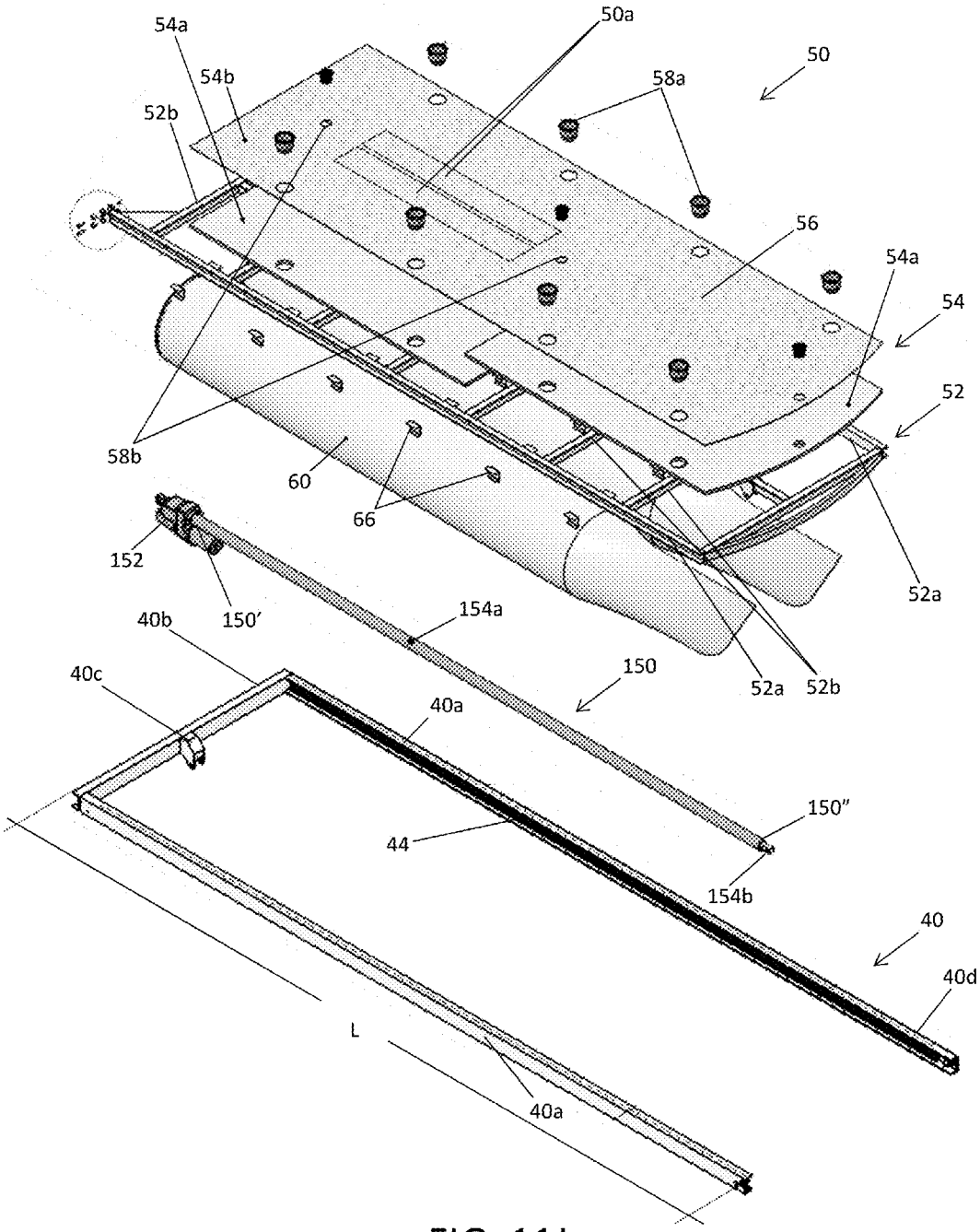

Details of the guide rail 40 and lower deck 50 are illustrated in FIG. 11. Generally, the lower deck is formed from a frame 52 and a floor 54. The outer sides of the lower deck's frame 52 are formed from side beams 52*a*, and the side beams are spaced apart by crossbeams 52*b*. The guide rails have a pair of parallel longitudinally extending c-channels 40*a* attached to the bottom of the upper deck's frame 20 and facing inwardly toward the central longitudinal axis. An aft end section 40*b* connects the longitudinal c-channels, and an actuator bracket 40*c* is attached to the aft end section. An upper roller bearing assembly 42*a* and a lower bearing assembly 42*b* are attached to the c-channels at the front ends 40*d* of the guide rails. Since these front roller bearings 42' are attached to the guide rails 40 which are fixed in place through their connections to the main deck, the front roller bearings are fixed and do not move relative to the main deck as the lower deck is extended and retracted. A plastic guide channel 44 is fitted into the inwardly facing c-channels. The plastic guide channel insert has a side portion 44*a*, a top portion 44*b*, and a bottom portion 44*c* which engage with the side beams 52*a*. Each one of the roller bearing assemblies 42 has a roller secured to the front section 40*d* of the guide rail with a shoulder bolt, washer and nut. The frame's side beams 52*a* are preferably formed of c-channels 52*c* with the web portion connected to the crossbeams 52*b* and flanges extending outwardly within the guide rail's inwardly facing c-channels. The outer sides of the flanges engage the plastic guide channel insert, and the inner sides of the outwardly facing flanges engage the rollers of the roller bearing assemblies.

The bottom side of the lower deck frame 52 is preferably welded or bolted to brackets 66 on their top sides, and the brackets are also attached to the amidships pontoons 60, preferably with welds or bolts. In addition to the side beams 52*a* and crossbeams 52*b* extending between the side beams, the lower deck frame 52 also includes mounting brackets 52*d* attached to each one of the side beams 52*a* at the aft end of the frame and may also include a stern center beam and a bow center beam for additional support. Upper and lower roller bearing assemblies 42 are secured to the mounting brackets 52*d* at their roller bearing mounting section 52*d'* that projects aft of the side beams. Since these aft roller bearings 42" are attached to the frame's side beams 52*a*, the aft roller bearings move with the lower deck relative to the main deck as the lower deck is extended and retracted. The mounting brackets have a side beam connection section 52*d"* that is perpendicular to the roller bearing mounting section 52*d'* and projects outwardly with the frame's flanges. The side beam connection section 52*d"* is attached to and extends between the frame's flanges and at least partially closes off the aft end of the frame. The aft rollers 42" engage the inner flanges of the inwardly facing c-channels or their channel inserts. The side beam connection section 52*d*" in each of the mounting brackets engages the front roller bearings 42' when the secondary deck is in the fully extended position and serves as a stop mechanism 160 that limits the secondary deck's maximum range of travel to within the length (L) of the guide rails and prevents the secondary deck 50 from extending beyond and breaking away from the guide rails 40 and the actuator 150.

The fixed front roller bearings 42' and the moving aft roller bearings 42" allow the lower deck 50 and its hull 60 to freely extend and retract as they are attached together throughout their range of travel, between the stowed position 70 and the fully extended position 80. The lower deck 50 is connected to the upper deck 10 preferably through both the guide rail 40 and the actuator 150. The actuator preferably holds the lower deck in its stowed position 70 and in its fully extended position 80, and the hard stop 160 is available to prevent the lower deck from breaking its connections to the upper deck through the actuator and to the guide rails. The lower deck's frame 52 is permanently attached to the hull 60 through bolts, welds or other fasteners. Accordingly, there is no releasable friction fit between the lower deck and its hull which would allow the lower deck's frame to separate from the hull such as would be possible with a tapered channel that receives a side beam. With a permanently fastened lower deck frame, the present invention is able to accommodate a lower deck 50 with a laterally expandable deck surface 90 which would not be possible if a releasable friction fit were used between the lower deck and its one or more hulls 60.

The top side plane 56 of the lower deck's upper side has a deck floor board 54*a* bolted to the lower deck frame 52 and a flooring material 54*b* laid over the deck floor board. The deck floor board is preferably made from marine grade wood decking or may be formed from plastic or composite materials in one or more sections. The flooring material is preferably glued or epoxied to the deck floor board. As explained in further detail with respect to FIGS. 17-20 below, various holders and mounts 58 are preferably recessed into the deck floor board, such as cup holders 58*a*, pole receivers 58*b*, seat mounting brackets 58*c*, hammock stands 58*d* and other types of mounting brackets 58*e*, such as for seat lifts. Additionally, as described above, access panels 50*a* can be incorporated into the lower deck structure with corresponding storage containers 62*a* installed beneath the lower deck.

The secondary deck 50 can have different types of expandable deck assemblies other than the foldable wings 90*a* as discussed above and shown in FIGS. 3A and 3B. For example, as illustrated in FIGS. 12A-12K and FIG. 16A, a series of pivoting arms 68*b* connect the bottom sides of the starboard panel and port panel to the secondary deck frame so that the laterally reciprocating panels 90 can move from their amidships positions to their abeam positions. In these embodiments, the secondary deck 50 is supported by a monohull 60*c* which has a storage hold 62*b* between sealed side flotation chambers 64. Preferably, the secondary deck also includes a fixed back panel 50*b* above the stern of the monohull. When the lower deck is in its fully extended position, the aft section of the back panel can remain partially under the upper deck's bow while the fore section of the back panel extends past the upper deck's bow, providing a clearance distance (D) for the opening of the laterally expandable panels and also providing a platform from the upper deck to the lower deck in this clearance distance.

A pair of side actuators 150 are preferably used in the monohull embodiments to maximize the size of the storage hold. Channels, indentations or other recesses 72 are formed in the monohull above the side flotation chambers 64 and below the lower deck 50 to allow the side actuators to extend past the stern end of the monohull toward the bow of the monohull. Even with a pair of pontoons, an under-deck storage hold could fit in the space between the pontoons. For example, if side actuators are used as shown in the embodiment of FIG. 12 with a twin pontoon extendable deck, such as shown in FIG. 11, a single center container could fit between the pontoons rather than using two (2) containers on opposite sides of the actuator.

Figure 12B:
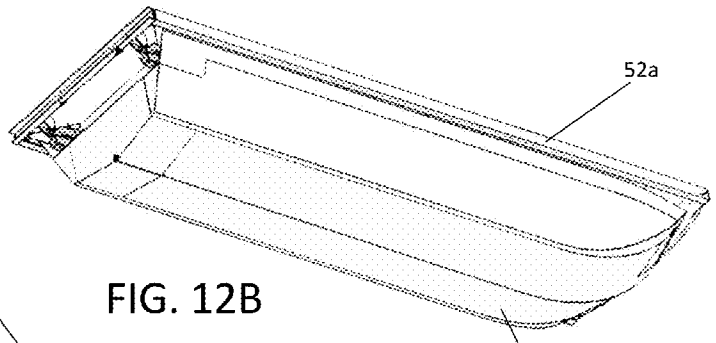
FIGS. 12A-12K illustrate a secondary deck with an alternative expandable deck assembly.
Figure 12A:
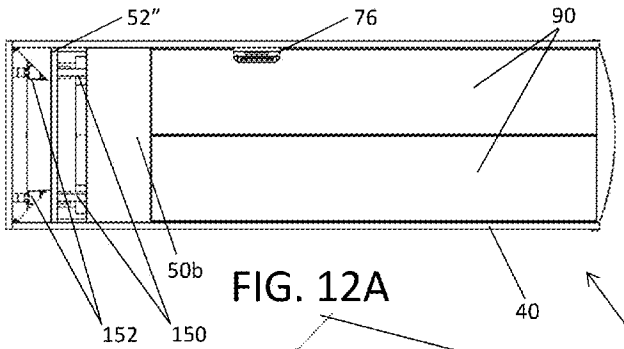
Figure 12C:
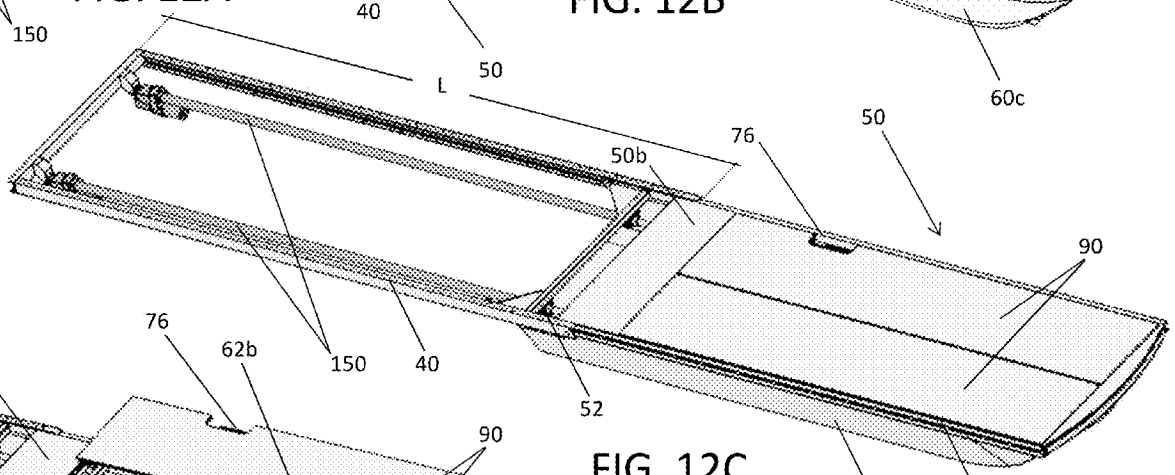
Figure 12E:
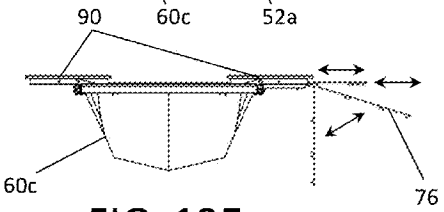
Figure 12D:
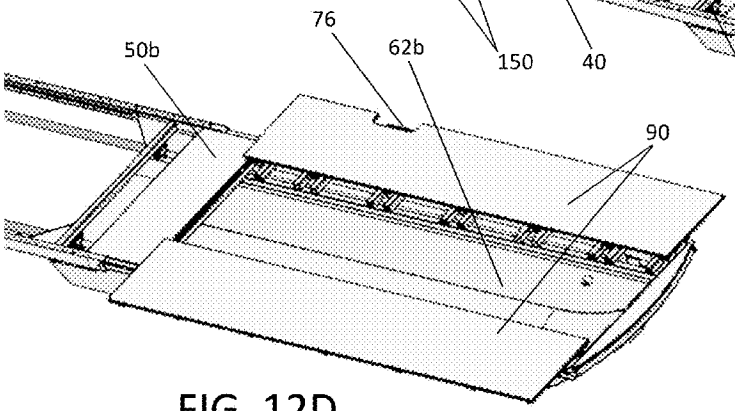
Figure 12F:
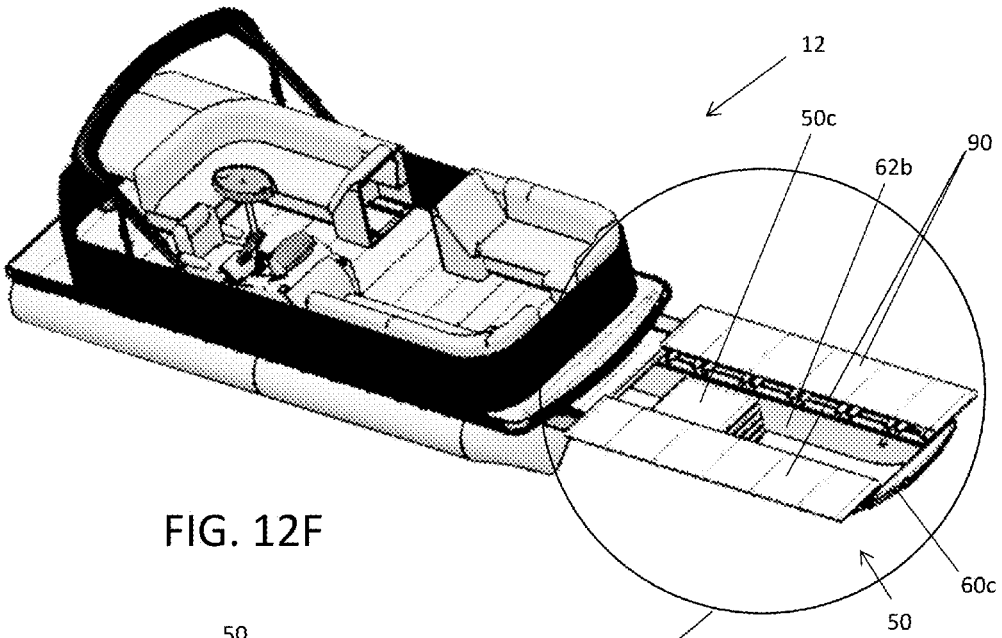
Figure 12G:
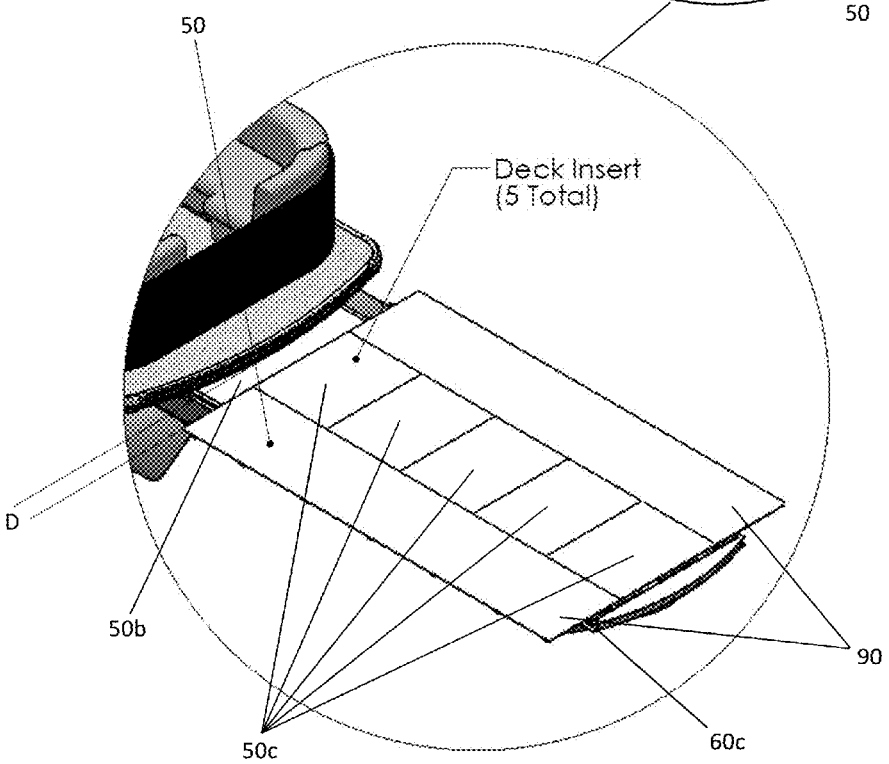
Figure 12H:
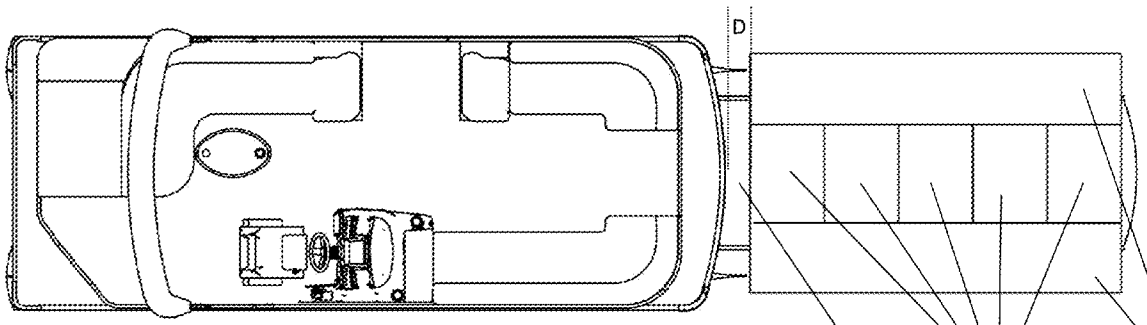
Figure 12I:
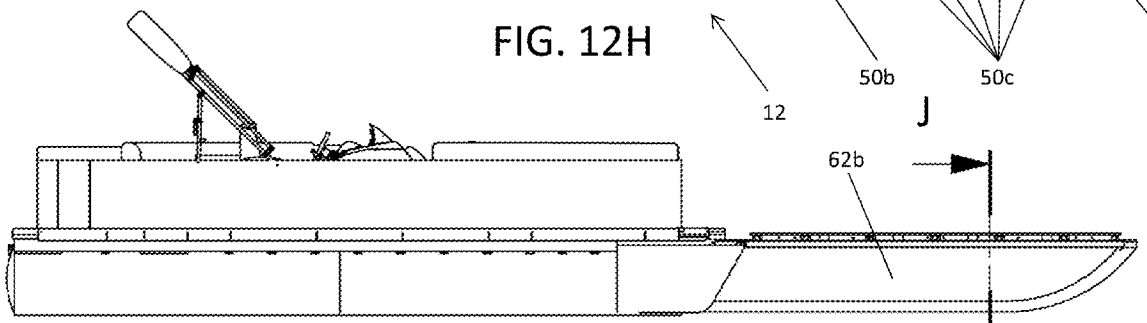
Figure 12K:
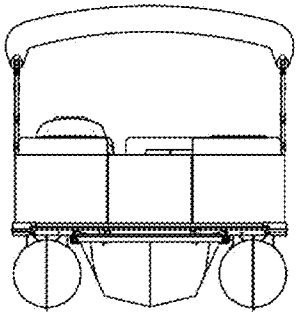
Figure 12J:
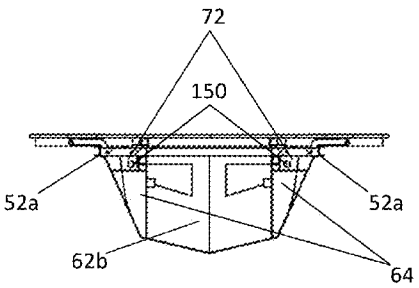

As shown in FIGS. 12F and 12G, structural panel inserts 50*c* can be stowed in the storage hold 62*b* and secured to the frame 52 on opposite sides of the hold to span the hold and provide a continuous deck surface 50 with the laterally expandable panels in their abeam positions. It will also be appreciated that the starboard and port deck panels could alternatively slide between their amidships and abeam positions. A telescoping or foldable ladder 76 could be stowed between a pair of crossbeams and slid outward to where it is rotated and extended down to into the water.

For the monohull embodiments, the frame 52 for the lower deck 50 could be similar to the frame 52' of the pontoon pair embodiments in which the side beams 52*a* are connected to the hull by fasteners and brackets. Alternatively, the side beams 52*a* may actually be formed as a part of the monohull sides, preferably above the side flotation chambers 64 and the recesses 72 through which the side actuators extend. Accordingly, the lower deck frame 52 could be attached to the monohull sides with fasteners, or the monohull sides could actually serve as a part of the frame 52" for the lower deck.

Figure 13A:
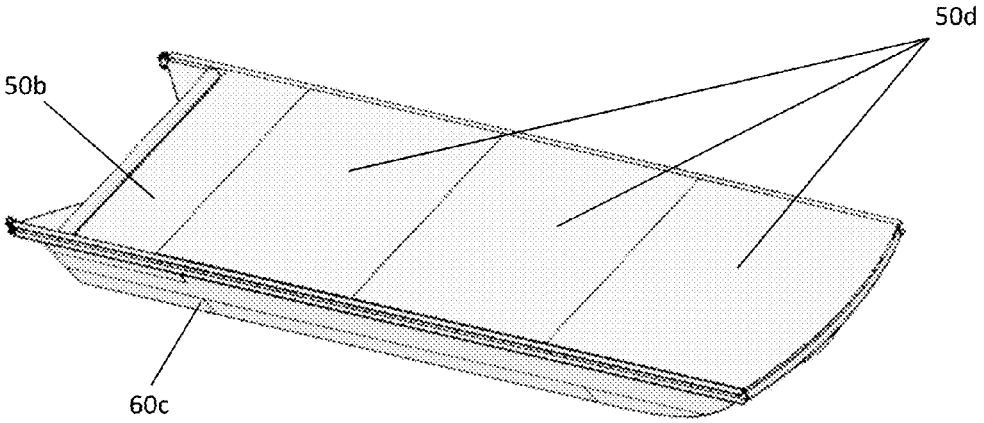
FIGS. 13A-13C illustrate a secondary deck with a convertible deck assembly.
Figure 13B:
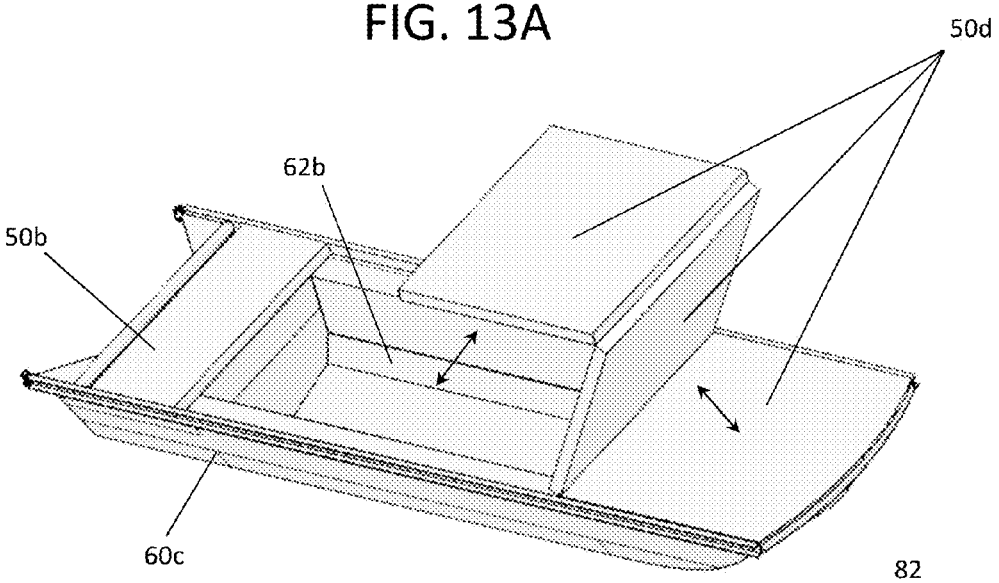
Figure 13C:
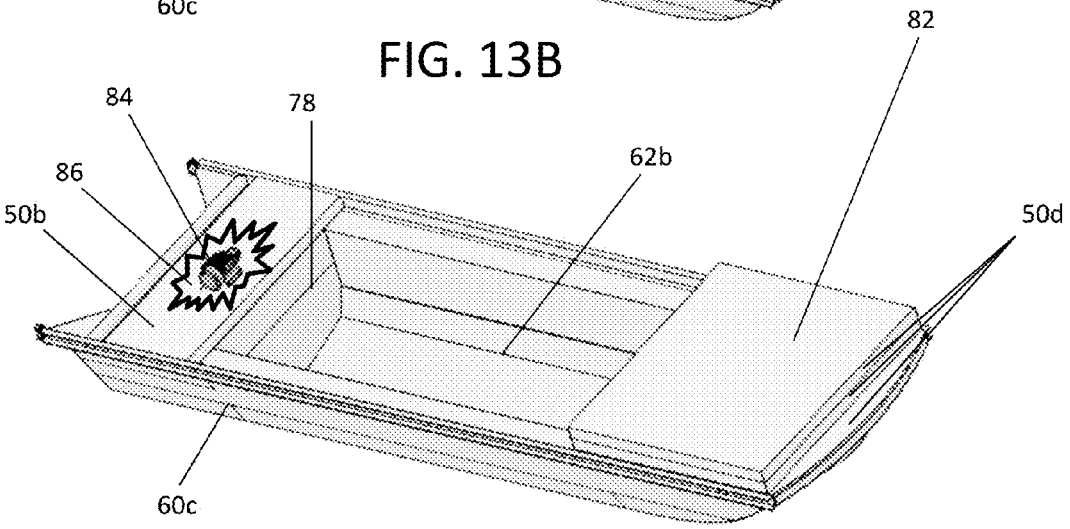
Figure 14A:
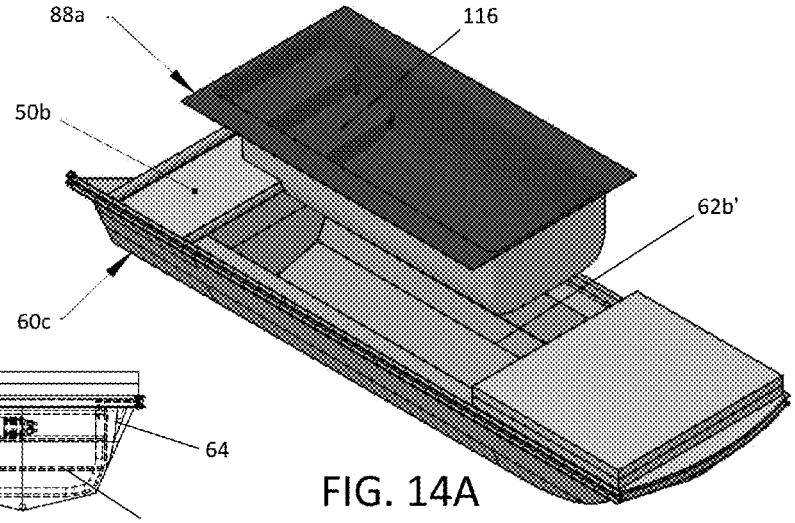
FIGS. 14A-14C illustrate a secondary deck with a pool liner insert.
Figure 14B:
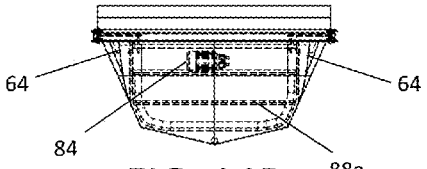
Figure 14C:
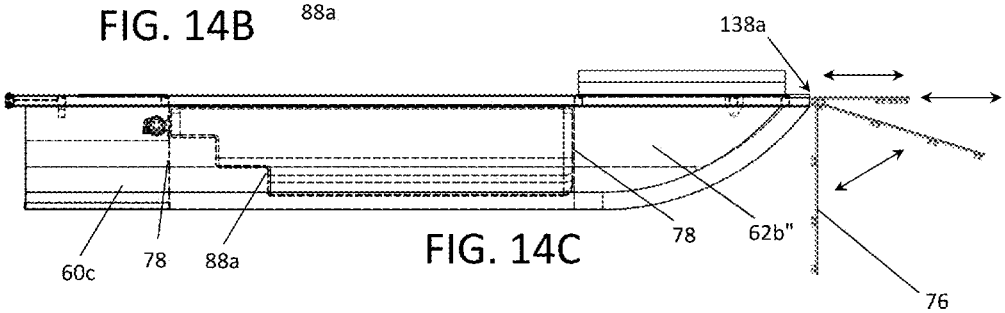
Figure 15:
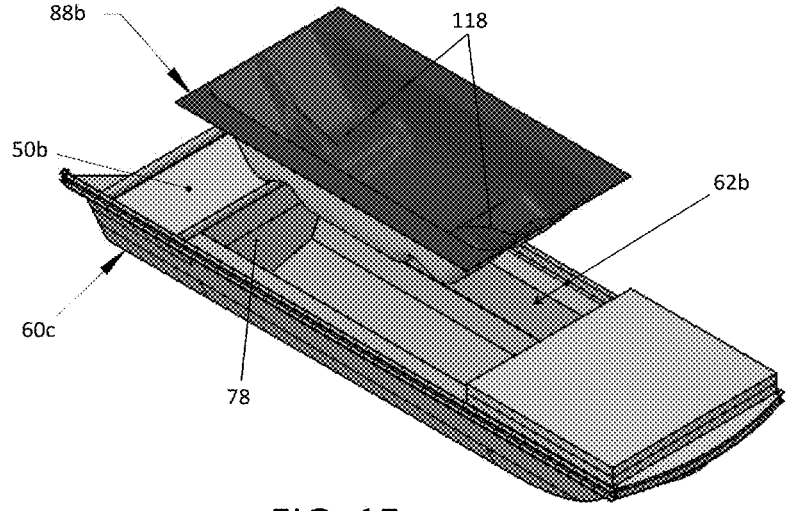
FIG. 15 illustrates a secondary deck with a hot tub liner insert.

FIGS. 13A-13C illustrate a secondary deck 50 that has a convertible deck assembly 50*d*. The structural panel sections of the convertible deck panels 50*d* are preferably hinged on alternating sides of the panels to allow for folding the panels on top of each other in a stacked configuration 82. Under an aft deck section, a bilge pump or other water pump 84 can be secured within a recessed space 86 beneath the back panel 50*b*. As illustrated in FIGS. 14A-14C and FIG. 15, a watertight shell 88 can be installed into the storage hold 62*b* between the side flotation chambers 64, such as a pool liner insert 88*a* having preformed stairs 116 or a hot tub liner insert 88*b* having preformed seats 118. The water pump is in fluid communication with the interior of the watertight shell, such as through conduits, pipes and valves, and can partially fill the watertight shell with water from the body of water within which the amidships hull is floating when the amidships hull and lower deck are in their extended position and can discharge the water back into the surrounding environment before the amidships hull and lower deck are retracted back into the stowed position and the watercraft 12 is underway. As shown in FIG. 14C, a telescoping or foldable ladder could be stowed under the bow of the secondary deck and slid outward to where it is rotated and extended down to into the water. It will be appreciated that a laterally expandable deck surface could be used in lieu of the convertible deck panels in these embodiments to provide for more of a deck surface around the pool or hot tub. It will also be appreciated that other types of watertight shells 88 could be secured within one or more storage hold sections 62*b*.

Figure 22A:
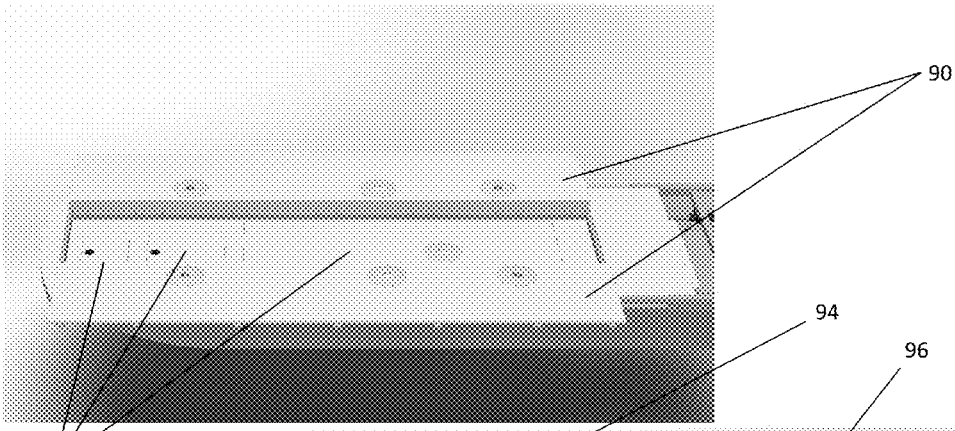
FIGS. 22A-22C illustrate a secondary deck with a grill, table, and stools.
Figure 22B:
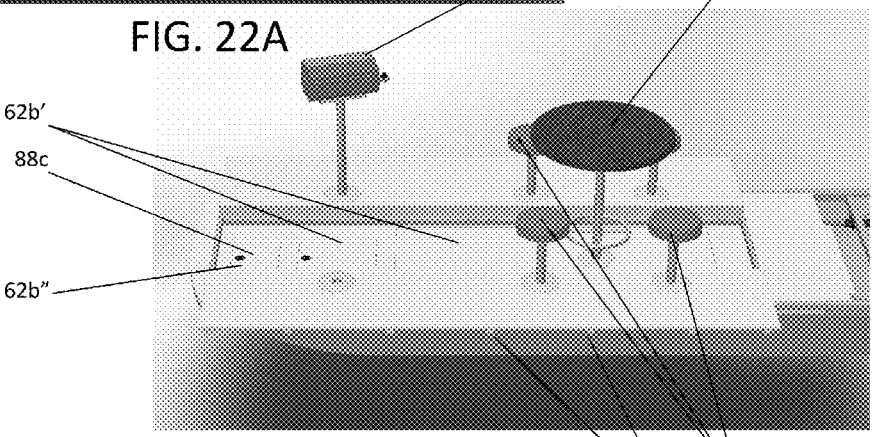
Figure 22C:
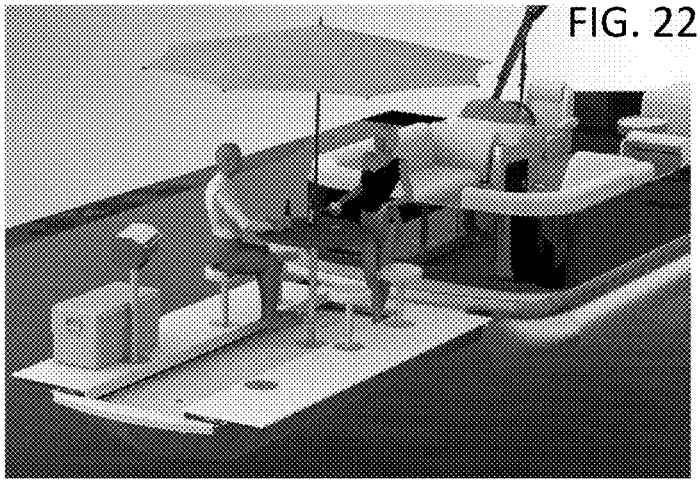
Figure 24A:
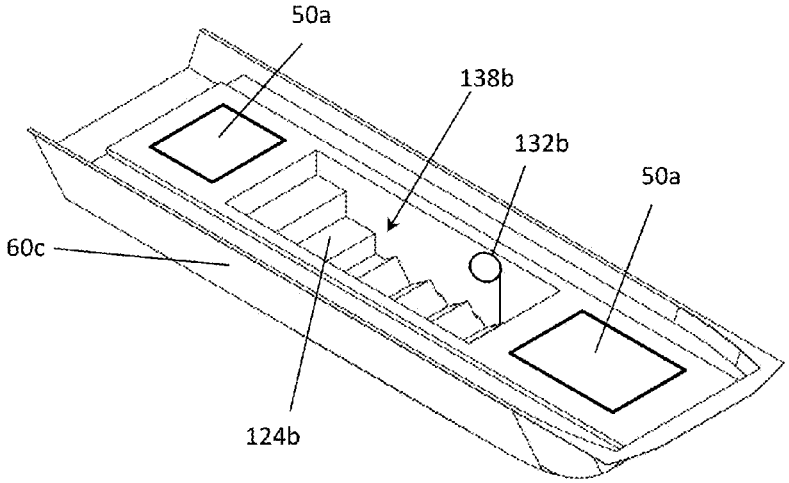
FIGS. 24A-24E illustrate an extendable hull with a gate rotatably connected at the center of the extendable hull in a raised position and in a lowered position.
Figure 24B:
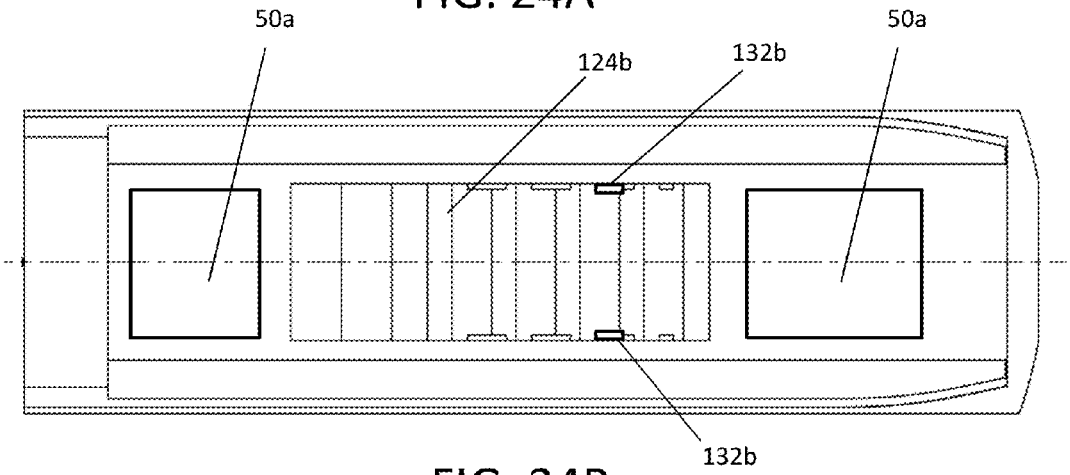
Figure 24C:
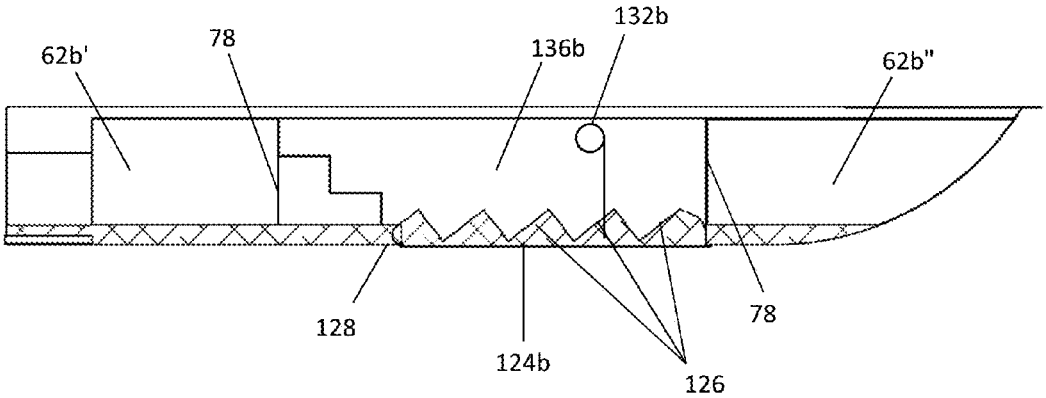

The storage hold 62*b* below the secondary deck can be separated into multiple storage hold sections by watertight shells 88 or by bulkheads 78 that extend between and connect to the interior sides of the amidships hull. For example, as shown in FIG. 14C, a bulkhead 78 separates the aft storage hold section 62*b*' which contains the shell from a forward storage hold section 62*b*". Similarly, as shown in FIGS. 22A-22C, one or more live wells 88*c* could be installed into the forward storage hold section 62*b*" while the aft storage hold section 62*b*' could have a shell that is formed with partitions that divide regions of the shell. One shell region may be used to store dry goods or a grill 94 while another shell region can be used to store other types of equipment, such as a table 96 and stools 98. As shown in FIG. 24C, multiple bulkheads 78 can separate the aft storage hold section 62*b*' and the forward storage hold section 62*b*" from a well 208 between the bulkheads. Accordingly, it will be appreciated that different types of watertight shells 88 could be secured within one or more storage hold sections multiple storage holds could be separated by bulkheads.

Figure 16A:
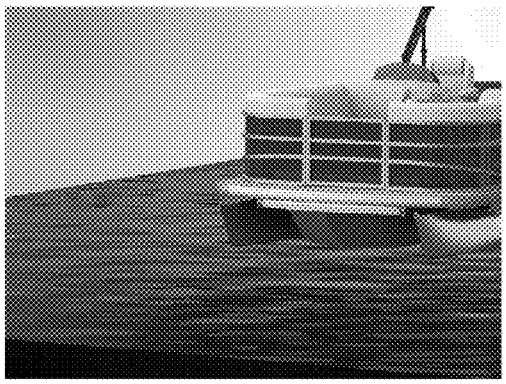
FIGS. 16A-16G illustrates a secondary deck with a stowable slide.
Figure 16B:
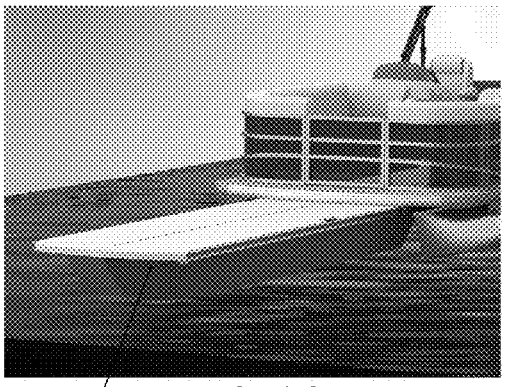
Figure 16C:
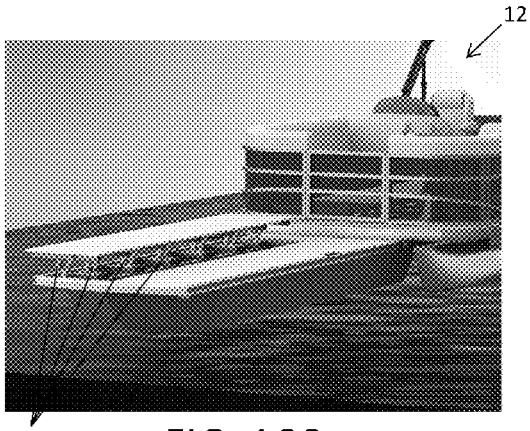
Figure 16D:
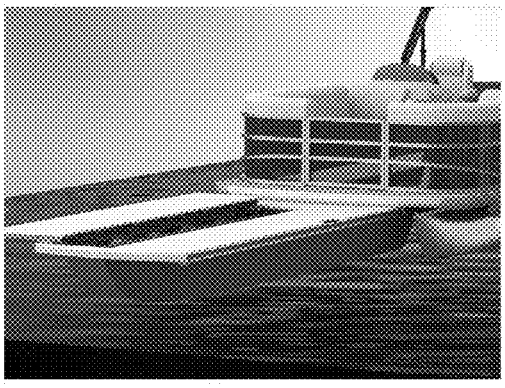
Figure 16E:
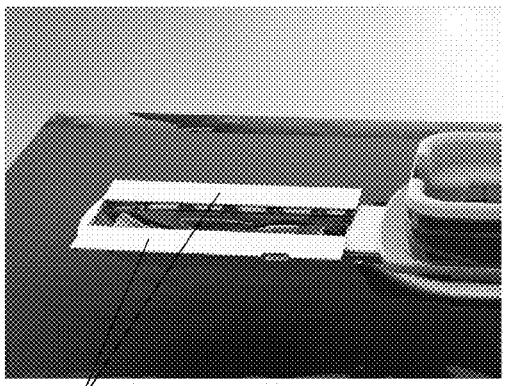
Figure 16F:
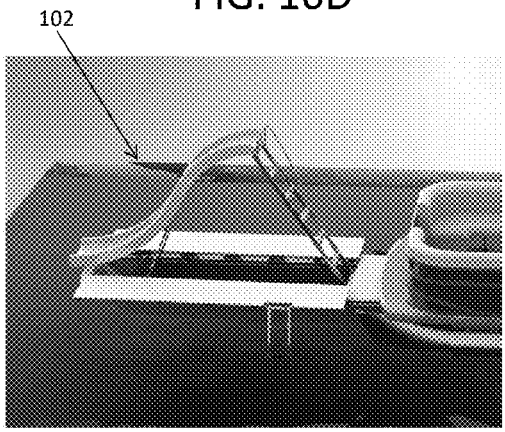
Figure 16G:
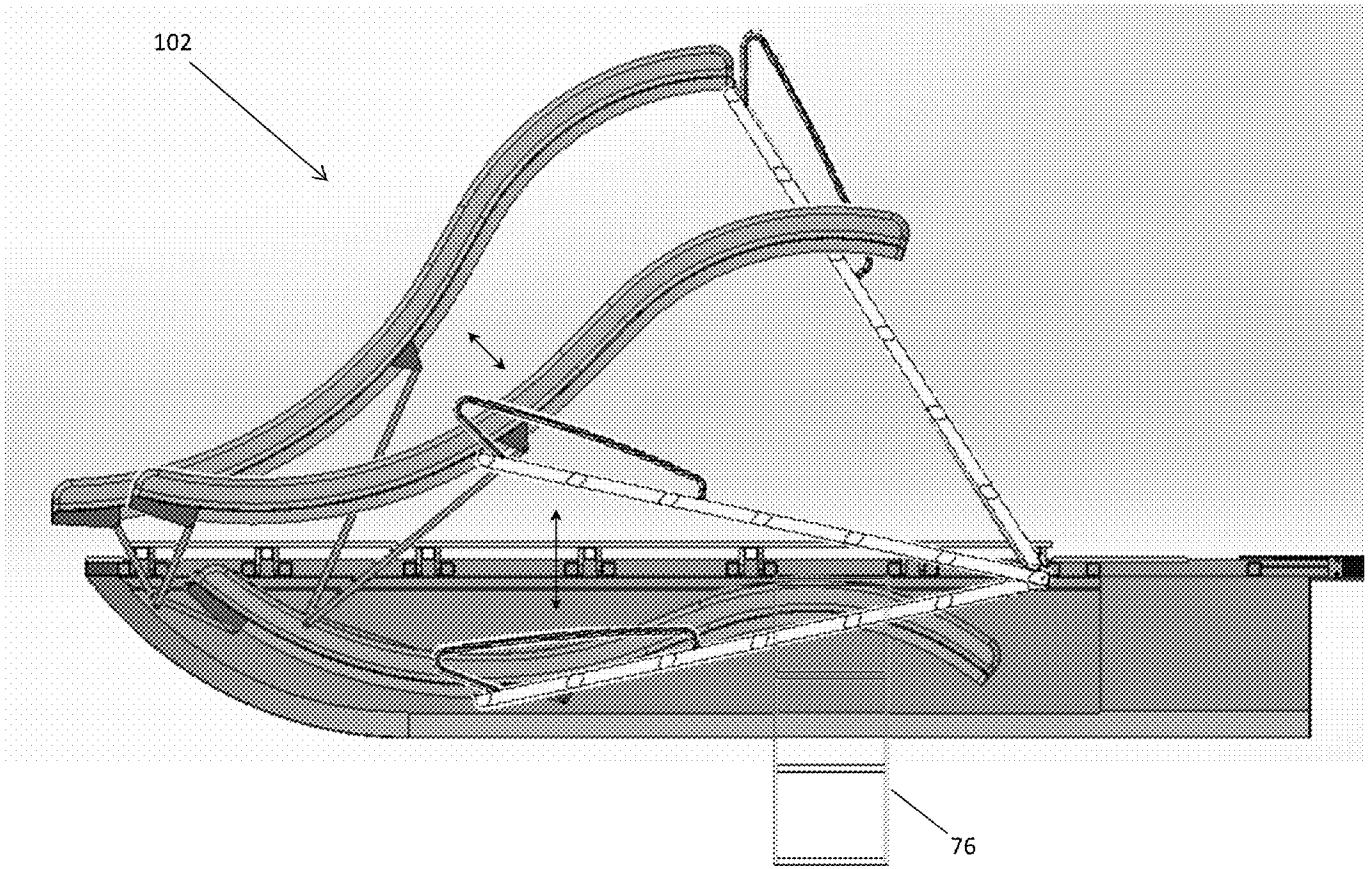
Figure 17B:
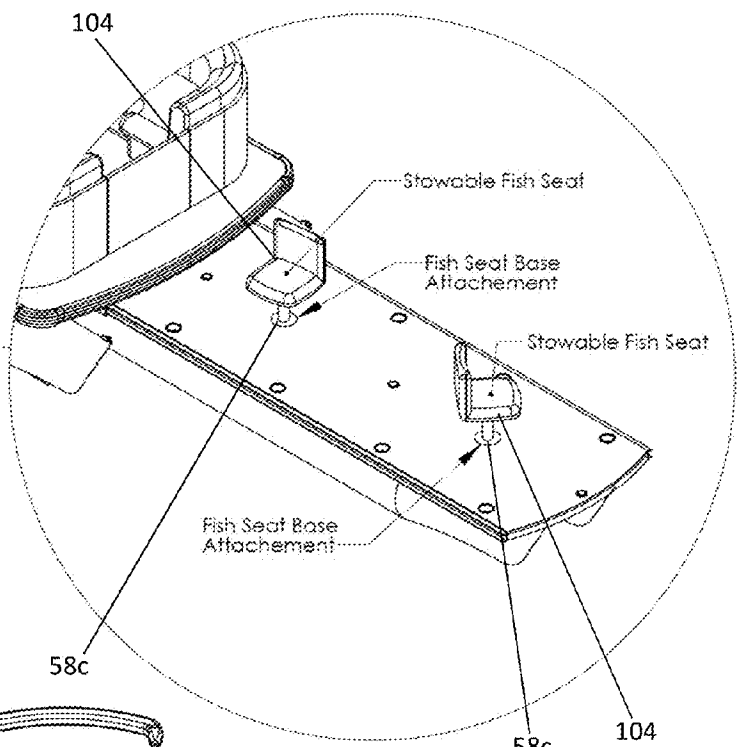
FIGS. 17A-17E illustrate a secondary deck with stowable fishing seats.
Figure 17E:
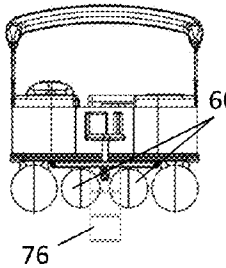
Figure 17A:
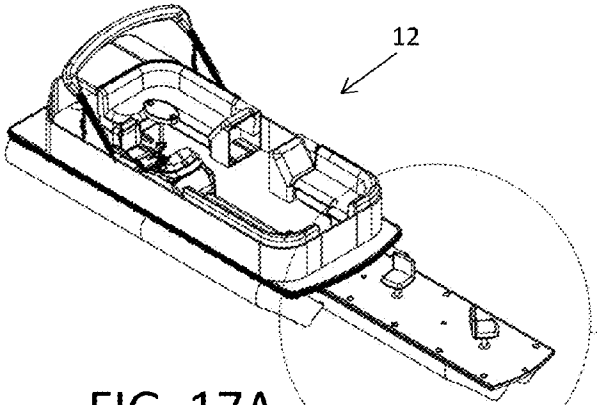
Figure 17C:
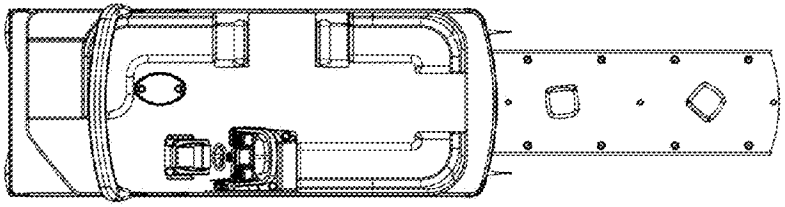
Figure 17D:
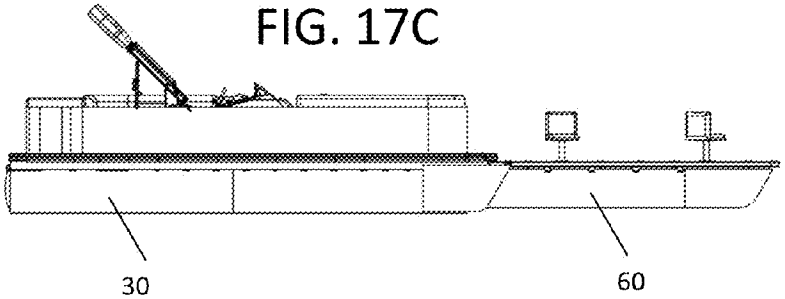
Figure 18:
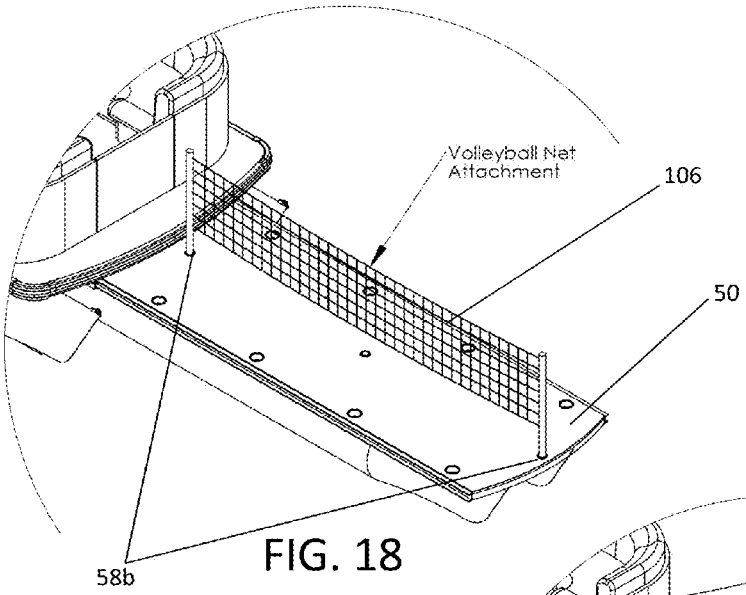
FIG. 18 illustrates a secondary deck with a volleyball net.
Figure 19:
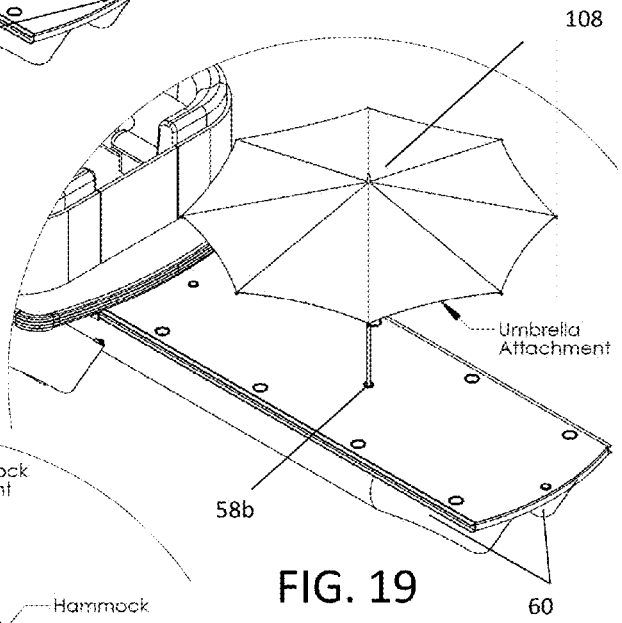
FIG. 19 illustrates a secondary deck with an umbrella.
Figure 20:
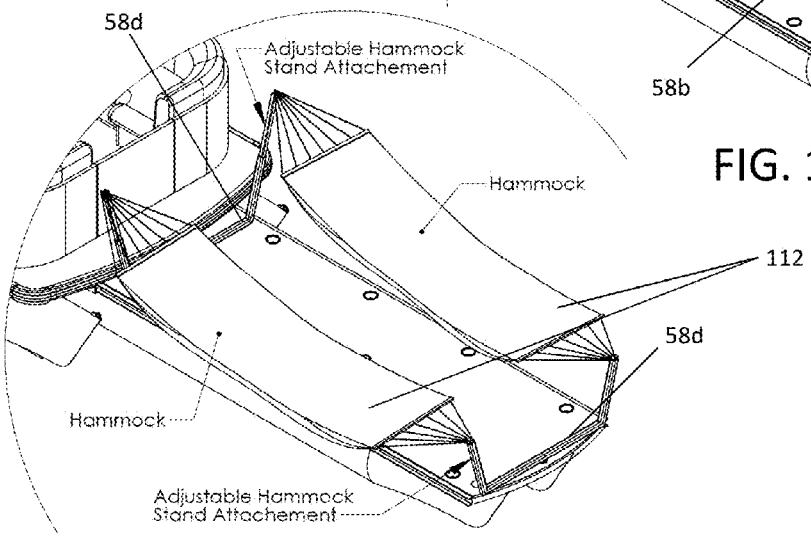
FIG. 20 illustrates a secondary deck with hammocks.
Figure 21A:
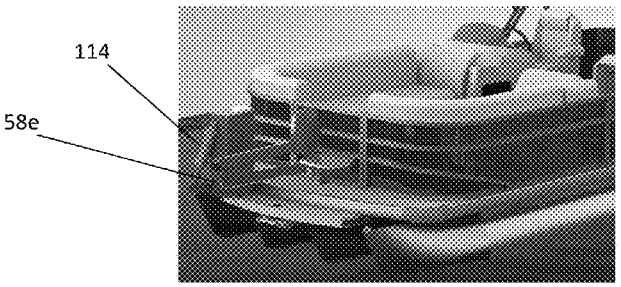
FIGS. 21A-21D illustrate a secondary deck with a seat lift.
Figure 21B:
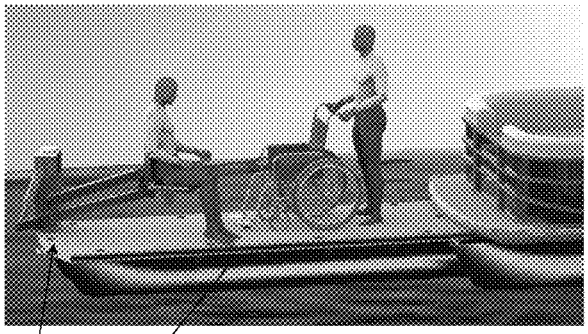
Figure 21C:
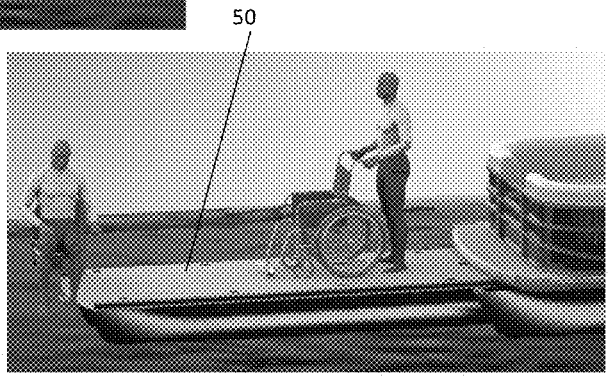
Figure 21D:
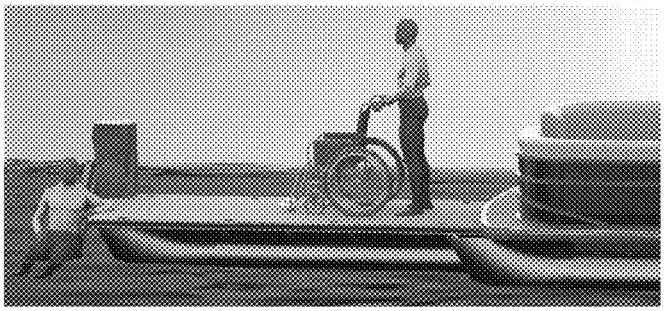

FIGS. 16A-16D illustrate the lower deck and monohull as they slide out from their stowed position underneath the upper deck to their extended position, and also illustrate the laterally reciprocating platforms 90*b* that pivot from their closed position covering the storage hold to their extended positions cantilevered over the sides of the monohull. FIGS. 16E and 16F illustrate a slide and ladder assembly 102 in its folded stowed configuration as it is lowered below the lower deck and in its operating configuration as it is raised above the lower deck, respectively. As illustrated in FIG. 16G, the slide and ladder assembly is stowed in the storage hold and rotated upward out of its stowed position within the hold into its operating position raised above the lower deck. It is possible for the slide and ladder assembly to be stowed in a storage hold which has convertible panels such as shown in FIG. 13 rather than the pivoting panels shown in FIG. 16. However, it is preferable to stow the slide and ladder assembly in the hold of the expandable deck assembly so that the starboard and port deck panels serve as seating and walking platforms on opposite sides of the slide when it is in its operating position. Additionally, it is preferable to have a ladder 76 extending from one of the sides or the bow of the lower deck down into the water.

As illustrated in FIGS. 17-22, a variety of other accessories can be folded or otherwise dismantled in their stowed configuration and lowered into the storage hold below the secondary deck and then unfolded or otherwise assembled in their operating configuration and raised above the secondary deck. Examples of the accessories include stowable fishing seats 104 and corresponding seat mounting bracket assemblies 58*c*, a volleyball net and pole assembly 106, an umbrella and pole assembly 108, and one or more hammocks 112 and corresponding stand assemblies 58*d*. The poles for the volleyball net and umbrella fit into the pole receivers 58*b*. Bases, mounting brackets, and other attachments are preferably connected to the deck frame to provide support for the fishing seats and hammocks. As illustrated in FIG. 21, a seat lift 114 could also be mounted to a bracket 58*e* at the bow of the secondary deck. FIG. 22 illustrates an expandable secondary deck with mounting brackets secured to the deck frame which hold a grill 94, table 96, and stools 98. The expandable secondary deck has a storage hold which is covered by structural access panels 50*a*. The accessories can be stowed in the storage hold 62*b*. As evident from the embodiment shown in FIG. 22, the laterally expandable secondary deck surface 90 can be used with any of the accessories discussed above and shown in the other illustrations and the laterally reciprocating surface 90*c* can slide out on tracks 68*c*. For example, the convertible deck panels shown in FIGS. 13-15 can be underneath the expandable deck panels, and the accessories secured to the deck frame in FIGS. 17-20 can be used with the expandable deck.

As described above and shown in FIGS. 14C, 16G, and 17E, a ladder 76 can extend from one of the sides of the lower deck or from the bow of the lower deck to allow persons to readily climb from the water to the lower deck or to lower themselves into the water from the deck. Additionally, as described above with reference to FIGS. 21A-21D, a seat lift 114 could also be mounted to the lower deck to provide another way for accessing the water, especially for persons with physical disabilities that would prevent them from using a ladder. These water accessing devices are at the exterior sides of the lower deck and its hull, i.e., around the periphery 138*a* of the lower deck 50 and extendable hull 60. As discussed below with reference to FIGS. 23-25, an alternative way of accessing the water would be from a gate mechanism 124 positioned within the interior space 138*b* of the extendable hull 60 between its sidewalls 138*c* rather than around the periphery 138*a* of the extendable hull 138*a* and its lower deck 50.

Figure 23A:
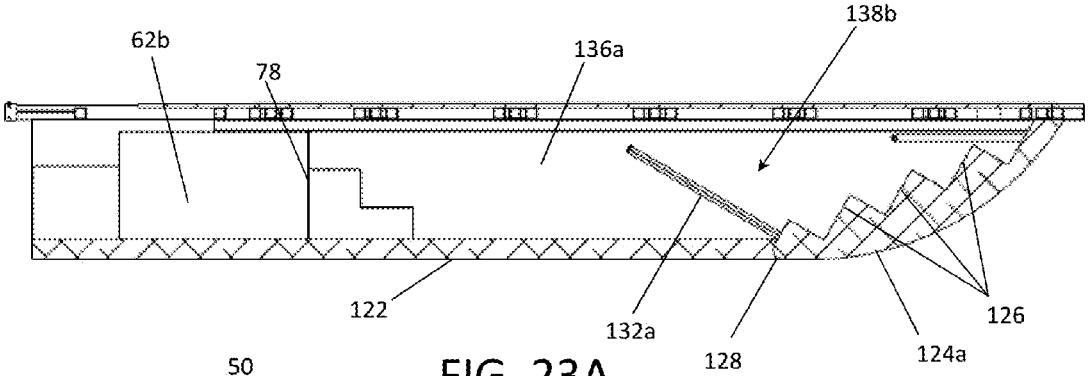
FIGS. 23A-23E illustrate an extendable hull with a gate rotatably connected at the bow of the extendable hull in a raised position and in a lowered position.
Figure 23B:
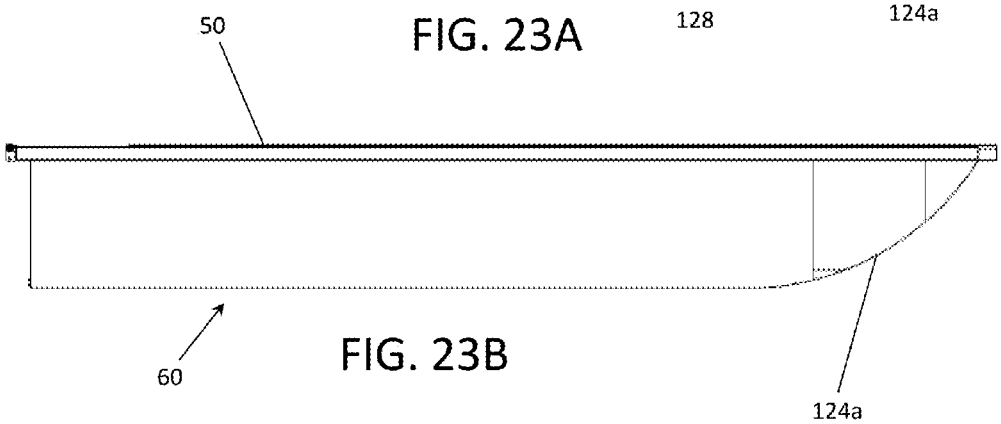
Figure 23C:
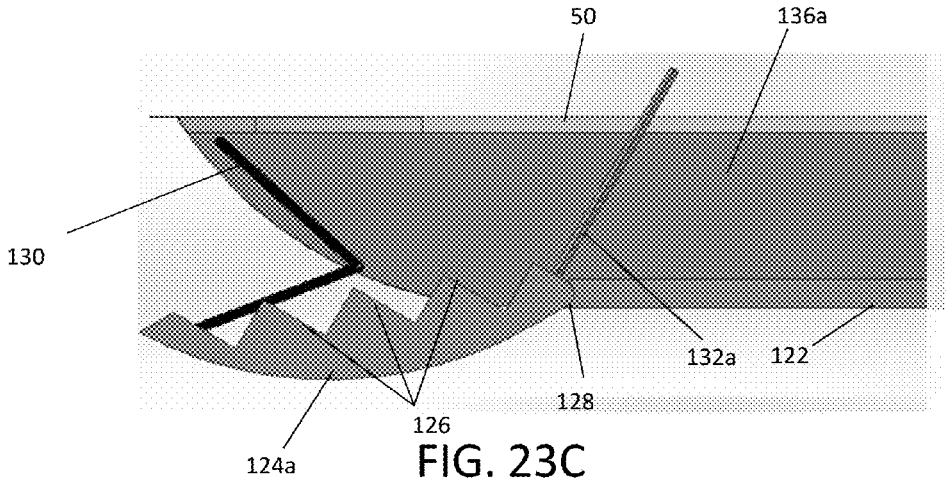
Figure 23D:
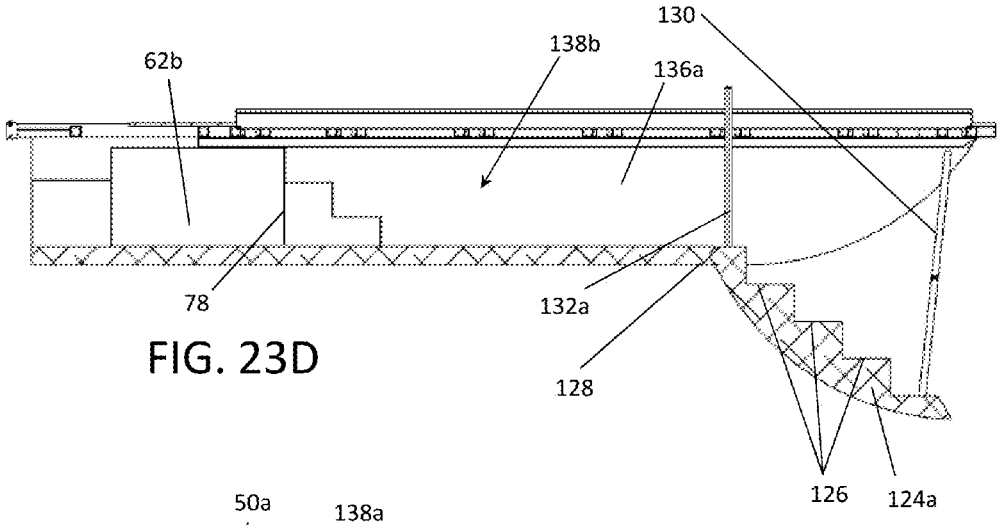
Figure 23E:
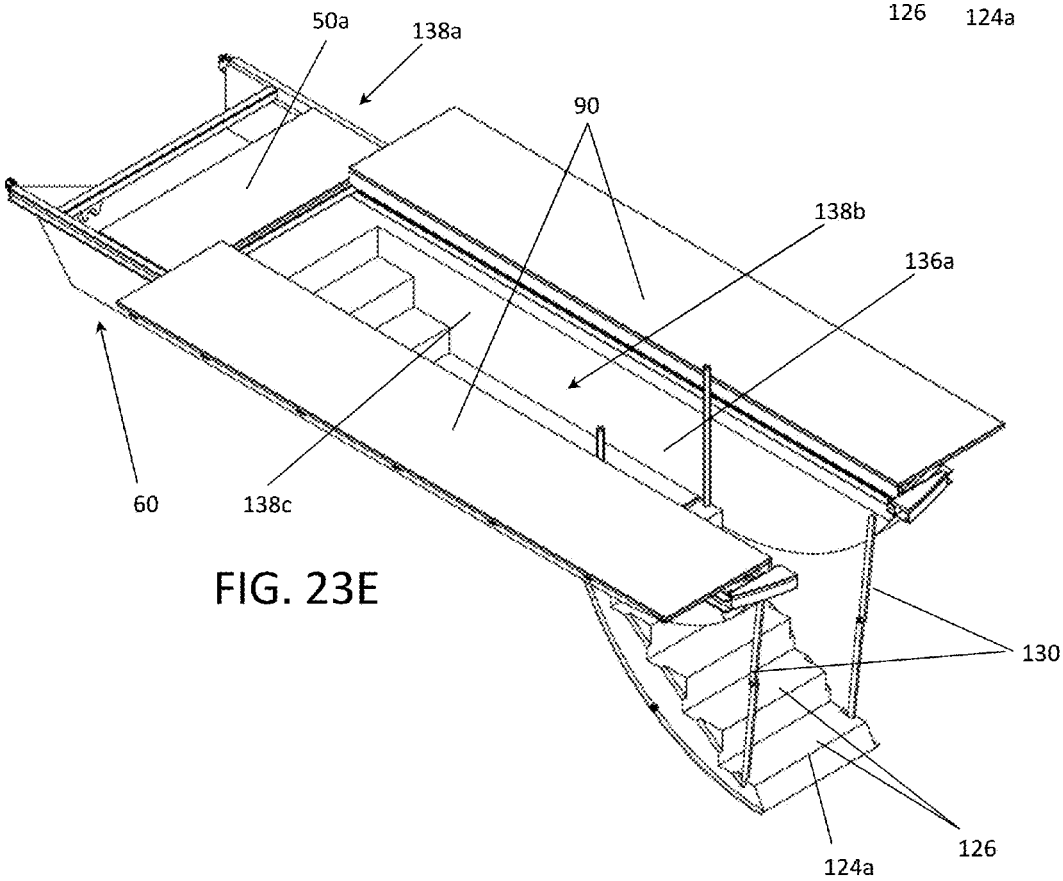
Figure 24D:
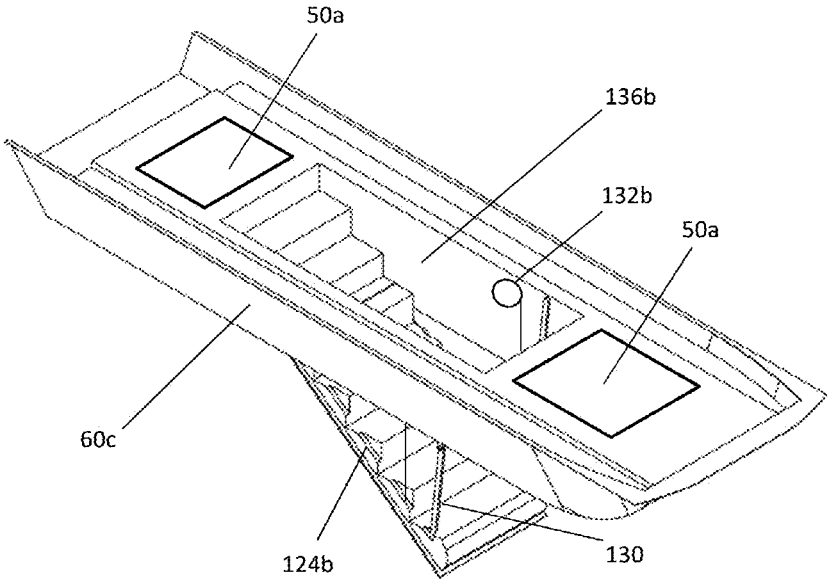
Figure 24E:
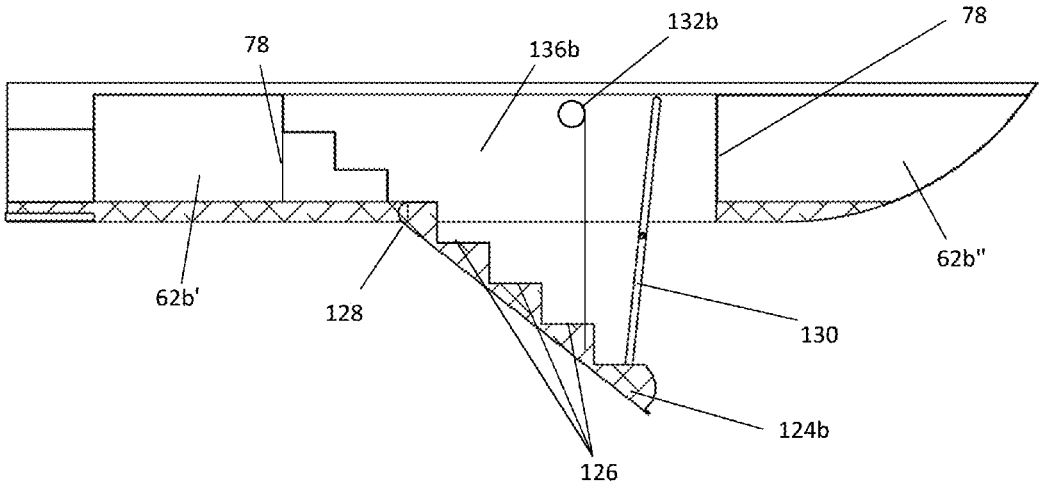
Figure 25A:
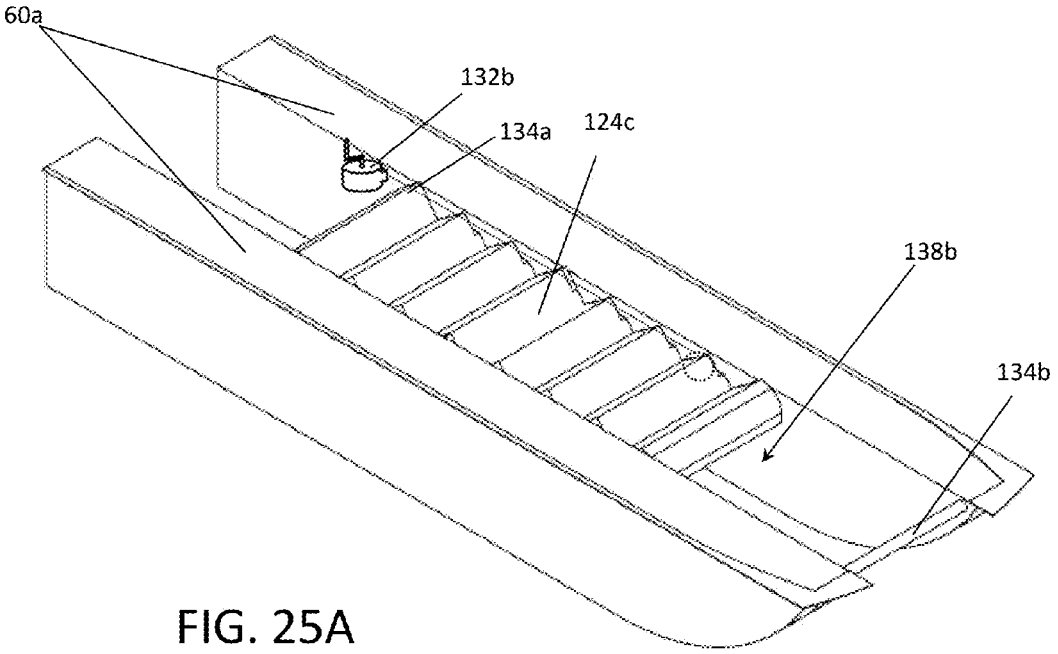
FIGS. 25A-25D illustrate an extendable hull with a gate rotatably connected between the extendable hull in the open and closed positions.
Figure 25B:
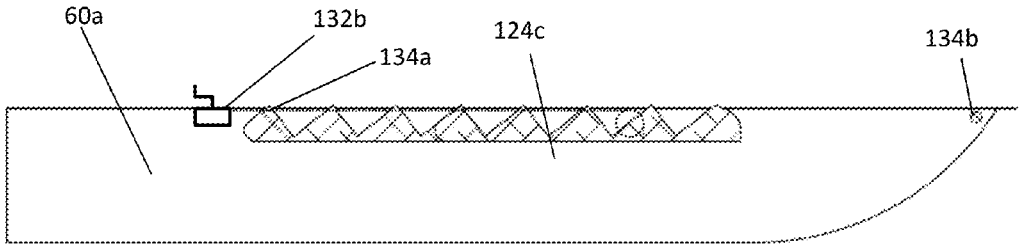
Figure 25C:
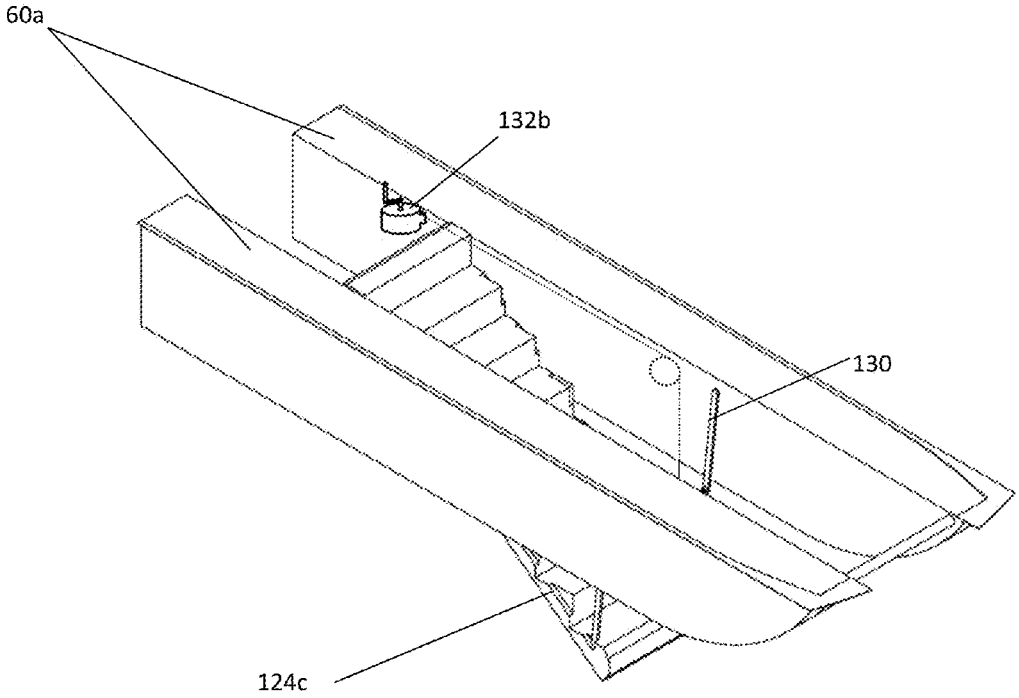
Figure 25D:
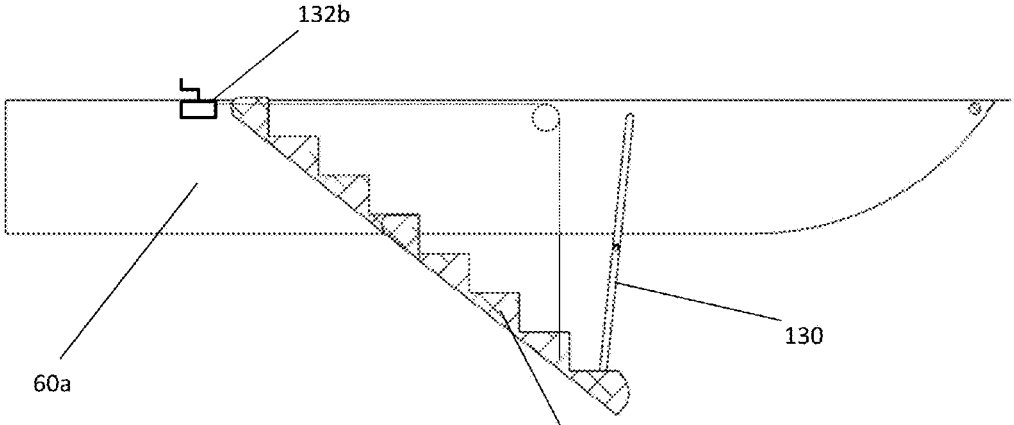

The gate 124 is another type of accessory that is located within the interior space 138*b* of the hull, but rather than being contained within a storage hold, the gate serves as a part of the hull's structure and connects to the hull 60 and is positioned within the hull's sidewalls 138*c*. Generally, the gate 124 rotates from a raised, stowed position as shown in FIGS. 23A, 24A, and 25A to a lowered, deployed position below the bottom side 122 of the extendable hull 60 as shown in FIGS. 23D, 24D, and 25D. The gate 124 may include steps 126 and has a proximal end that is rotatably connected to the hull through a hinge, a rotating mounting bracket, or some other type of pivot joint 128. The proximal section of the gate can be connected to the hull anywhere between the bottom of the hull, such as shown in FIGS. 23C and 24C, and the top of the hull, such as shown in FIG. 25A, at any structural element of the hull 60, such as transverse or longitudinal frame members, an inner beam extending between frame members, stringers, or even supports built into the hull walls, while the distal end of the gate rotates relative to the hull. Although the embodiments of the gates described herein and shown in the drawings have the pivot joint located at the aft gate section and have a forward gate section that is lowered into the water below the bottom side of the hull, it will be appreciated that these features could be reversed so that the pivot joint is located at the forward gate section and the aft gate section is lowered into the water below the bottom side of the hull.

Supports 130, such as articulated arms or cables, preferably connect the distal section of the gate to the hull. The supports at the hull's distal section help bear and distribute the weight of the open gate between the gate's proximal and distal sections (and the additional weight of people when the gate is being used in its lowered position), thereby reducing the stress on the hinge at the proximal section. Arms may be preferable because they can better serve as handrails to help users stabilize themselves when using the gate. The supports can be actuated to move the gate 124 between the raised and lowered positions. In addition to articulating arms or cables, other types of supports 130 may be used including rope, telescoping arms, chains, linkages, or other means for bearing the lowered gate and user weight. Additionally, alternative actuators 132 can be used to move the gate 124 between the stowed and deployed positions, such as a lever arm 132*a* or a cable winch 132*b* that may be motorized or manually operated with a winch and a pulley. It will be appreciated that the winch and pulley assembly could be used in combination with the support 130 or in lieu of a support on one side of the hull; preferably, a cable or articulated arm would still be used on the other side of the hull. Preferably, a fastener or locking mechanism secures the gate when it is raised to the stowed position.

In one embodiment, the gate 124*a* can form the bow of the hull 60 which can be formed as a monohull or with a pair of pontoons, such as shown in FIG. 23. In another embodiment, the gate 124*b* can form the amidships keel of a monohull 60*c*, such as shown in FIG. 24. The bow gate 124*a* may be useful for loading, unloading, boarding and disembarking, either at the shoreline or offshore. The center section gate 124*b* is more suited primarily to offshore disembarking and boarding. In yet another embodiment, the gate 124*c* is pivotally connected between two spaced apart pontoons 60*a* with the proximal section serving as a brace 134*a* between the pontoons and another brace 134*b* between the pontoons at a location spaced away from the gate, such as illustrated in FIG. 25. In each of these embodiments, a secondary lower deck 50 can be connected to the pontoons and situated over the gate when the secondary deck is in a closed position and rotated to reveal the gate when the secondary deck is in an open position. Additionally, in each one of the embodiments the gate rotates from its raised, stowed position to its lowered, deployed position with the distal section of the gate extending below the bottom side of the amidships hull to allow for easier offshore disembarking and boarding. The inclusion of the steps on the gate could further help people more easily enter and exit the water. Although stairs are shown as the steps 126 in these embodiments, it will be appreciated that other types of steps could be used with the gate, such as a ramp with traction bars or anti-slip raised buttons, a ramp with a nonslip surface coating or slip-resistant treads, a gangway, a platform, or a ladder.

In the embodiments shown in FIGS. 23 and 24, the gate's proximal end is connected to the amidships hull through a pivot joint that is preferably watertight and resistant to rust. When the gate is in the raised position in these embodiments, it closes a well section 136 within the interior space 138*b* of the hull and preferably creates a watertight seal that prevents water from entering the closed well. In the embodiment shown in FIG. 23, there is only one bulkhead that divides the aft hold section from the forward section with the gate. Accordingly, the gate forms the front wall of a forward well 136*a*; when the gate is lowered, the well is opened and water can enter the open well, and when the gate is raised to its stowed position, the well is sealed and a pump can extract excess water. Similarly, in the embodiment shown in FIG. 24, there is a forward bulkhead and an aft bulkhead which creates a center well 136*b* that is situated between the aft hold section 62*b*' and the forward hold section 62*b*". In this embodiment, the gate forms the bottom of the well; when the gate is lowered, water can enter the open well, but buoyancy remains by way of the sealed sections of the hull, such as amidships pontoons 60*a* and the hold sections 62. When the gate is raised to close the well, any water remaining in the closed center well section can be extracted via a water pump or a one way water gate within the amidships' hull. The closed well may be used for storage of access panels 50*a* when the gate is raised without compromising the functionality of the gate as the bow or keel of the extendable hull 60 depending on the particular configuration.

According to the description of the embodiments above, it will be appreciated that the present invention provides several benefits over existing multihull vessels and floating docks. In particular, the present invention provides additional buoyancy that more than compensates for the increase in weight of the lower deck, the guides and the actuator system which increases the hauling capacity and gross vehicle weight of the multihull vessel. The present invention can also increase the maneuverability and stability of the multihull vessel as well as increase the useable deck space when the vessel is stationary. The present invention may also increase fuel economy of the vessel, especially when compared to a vessel with the same total useable deck space. When the invention is used with permanent dock structures, it increases the usable deck space.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. An extendable multihull boat, comprising:

an upper deck having an underside frame extending from a bow to a stern;

a pair of abeam hulls located beneath the upper deck and fixedly connected to the underside frame of the upper deck;

a pair of longitudinally elongated guide rails fixedly connected to the underside frame of the upper deck between the abeam hulls;

an amidships hull located below the underside frame of the upper deck and longitudinally arranged between the abeam hulls, wherein the amidships hull longitudinally translates relative to the upper deck, the abeam hulls, and the elongated guide rails between a stowed position and a fully extended position, wherein the amidships hull is positioned beneath the upper deck in the stowed position, wherein the amidships hull extends forward of the bow of the upper deck in the fully extended position, and wherein the amidships hull has a maximum range of travel between the stowed position and the fully extended position no greater than a length of the elongated guide rails;

a gate rotatably connected to and positioned within the amidships hull, wherein the gate moves with the amidships hull between the stowed position and the fully extended position, wherein the gate rotates at a proximal section between a raised position and a lowered position, and wherein a distal section of the gate extends below a bottom side of the amidships hull in the lowered position; and an actuator fixedly connected to the underside frame of the upper deck at an aft actuator end and fixedly connected to the amidships hull at a forward actuator end, wherein the actuator moves the amidships hull between the stowed position and the fully extended position through the maximum range of travel.

2. The extendable multihull boat of claim 1, wherein the gate forms at least one of a bow of the amidships hull, a keel of the amidships hull, and a brace between sides of the amidships hull, and wherein the gate is further comprised of a plurality of steps.

3. The extendable multihull boat of claim 1, wherein the raised position of the gate seals an interior space of the amidships hull from water surrounding the amidships hull with a closed well configuration, and wherein the lowered position of the gate produces an open well configuration and allows water surrounding the amidships hull into the open well configuration.

4. The extendable multihull boat of claim 1, wherein the amidships hull is a comprised of a monohull with a bulkhead, a well, and a storage hold, wherein the gate closes the well of the monohull in the raised position and opens the well of the monohull in the lowered position.

5. The extendable multihull boat of claim 1, wherein the amidships hull is comprised of a pair of spaced apart pontoons with a first brace connecting the spaced apart pontoons, wherein the proximal section of the gate serves as a second brace connecting the spaced apart pontoons, and wherein the first brace is located at a position spaced away from the second brace.

6. The extendable multihull boat of claim 1, further comprising a support connecting the distal section of the gate to the amidships hull, and an actuator operatively connected to at least one of the distal section of the gate and the support.

7. The extendable multihull boat of claim 1, further comprising a lower deck located below the underside frame of the upper deck between the abeam hulls, wherein the lower deck is fixedly attached to the amidships hull above the gate through a plurality of fasteners and moves with the amidships hull between the stowed position and the fully extended position, and wherein the amidships hull provides buoyant support to the gate and the lower deck in the stowed position and in the fully extended position.

8. The extendable multihull boat of claim 7, wherein the lower deck is further comprised of a plurality of structural panels, wherein the structural panels have a closed position covering the gate and an open position revealing the gate, wherein the structural panels are selected from the group of panels consisting of laterally reciprocating panels, access panels, panel inserts, convertible deck panels, and a combination thereof.

9. The extendable multihull boat of claim 7, further comprising:

a pair of side beams respectively connected to a port side and a starboard side of at least one of the lower deck and the amidships hull;

a first pair of roller bearings respectively attached to the pair of elongated guide rails proximate to the bow, wherein the first pair of roller bearings remain fixed with the pair of elongated rails relative to the underside frame of the upper deck as the lower deck and the amidships hull translate between the stowed position and the fully extended position, and wherein the pair of side beams respectively engage and slide on the first pair of roller bearings;

a pair of brackets attached to the pair of side beams proximate to an aft end of the lower deck; and a second pair of roller bearings respectively attached to the pair of brackets, wherein the second pair of roller bearings translate with the lower deck and the amidships hull between the stowed position and the fully extended position, and wherein the second pair of roller bearings respectively engage and roll on the pair of elongated guide rails.

10. The extendable multihull boat of claim 1, wherein the actuator is selected from the group of actuators consisting of a centerline actuator and a pair of side actuators.

11. An extendable multihull boat, comprising:

an upper deck having an underside frame extending from a bow to a stern;

a pair of abeam hulls located beneath the upper deck and fixedly connected to the underside frame of the upper deck;

a pair of longitudinally elongated guide rails fixedly connected to the underside frame of the upper deck between the abeam hulls;

an amidships hull located below the underside frame of the upper deck and longitudinally arranged between the abeam hulls, wherein the amidships hull longitudinally translates relative to the upper deck, the abeam hulls, and the elongated guide rails between a stowed position and a fully extended position, wherein the amidships hull is positioned beneath the upper deck in the stowed position, and wherein the amidships hull extends forward of the bow of the upper deck in the fully extended position;

a gate rotatably connected to and positioned within the amidships hull, wherein the gate moves with the amidships hull between the stowed position and the fully extended position, wherein the gate rotates at a proximal section between a raised position and a lowered position, and wherein a distal section of the gate extends below a bottom side of the amidships hull in the lowered position, wherein the raised position of the gate seals an interior space of the amidships hull from water surrounding the amidships hull with a closed well configuration, and wherein the lowered position of the gate produces an open well configuration and allows water surrounding the amidships hull into the open well configuration; and an actuator fixedly connected to the underside frame of the upper deck at an aft actuator end and fixedly connected to the amidships hull at a forward actuator end, wherein the actuator moves the amidships hull between the stowed position and the fully extended position through the maximum range of travel.

12. The extendable multihull boat of claim 11, wherein the amidships hull is at least one of a monohull and a pair of spaced apart pontoons, wherein the monohull is further comprised of a bulkhead, a well, and a storage hold, wherein the gate closes the well of the monohull in the raised position and opens the well of the monohull in the lowered position, wherein the spaced apart pontoons are further comprised of a first brace connecting the spaced apart pontoons, wherein the proximal section of the gate serves as a second brace connecting the spaced apart pontoons, and wherein the first brace is located at a position spaced away from the second brace.

13. The extendable multihull boat of claim 11, further comprising a support connecting the distal section of the gate to the amidships hull, and an actuator operatively connected to at least one of the distal section of the gate and the support.

14. The extendable multihull boat of claim 11, further comprising a lower deck located below the underside frame of the upper deck between the abeam hulls, wherein the lower deck is fixedly attached to the amidships hull above the gate through a plurality of fasteners and moves with the amidships hull between the stowed position and the fully extended position, and wherein the amidships hull and the lower deck have a maximum range of travel between the stowed position and the fully extended position no greater than a length of the elongated guide rails.

15. The extendable multihull boat of claim 11, wherein the actuator is selected from the group of actuators consisting of a centerline actuator and a pair of side actuators.

16. An extendable multihull boat, comprising:

an upper deck having an underside frame extending from a bow to a stern;

a pair of abeam hulls located beneath the upper deck and fixedly connected to the underside frame of the upper deck;

a pair of longitudinally elongated guide rails fixedly connected to the underside frame of the upper deck between the abeam hulls;

a lower deck located below the underside frame of the upper deck between the abeam hulls, wherein the lower deck longitudinally translates relative to the upper deck, the abeam hulls, and the elongated guide rails between a stowed position and a fully extended position, and wherein the lower deck is positioned beneath the upper deck in the stowed position, wherein the lower deck extends forward of the bow of the upper deck in the fully extended position;

an amidships hull located beneath the lower deck and fixedly connected to the lower deck through a plurality of fasteners, wherein the amidships hull is longitudinally arranged between the abeam hulls and longitudinally translates with the lower deck relative to the upper deck, the abeam hulls, and the elongated guide rails between the stowed position and the fully extended position, and wherein the fasteners hold the amidships hull in a fixed position relative to the lower deck when the amidships hull and the lower deck are in the stowed position and in the fully extended position;

a gate rotatably connected to and positioned within the amidships hull, wherein the gate moves with the amidships hull between the stowed position and the fully extended position, wherein the gate rotates at a proximal section between a raised position and a lowered position, and wherein a distal section of the gate extends below a bottom side of the amidships hull in the lowered position; and an actuator fixedly connected to the underside frame of the upper deck at an aft actuator end and fixedly connected to the amidships hull at a forward actuator end, wherein the actuator moves the amidships hull between the stowed position and the fully extended position through the maximum range of travel.

17. The extendable multihull boat of claim 16, wherein the amidships hull and the lower deck have a maximum range of travel between the stowed position and the fully extended position no greater than a length of the elongated guide rails, wherein the amidships hull and the lower deck are connected to the upper deck, the abeam hulls, and the elongated guide rails in the stowed position and in the fully extended position, and wherein the lower deck is further comprised of a plurality of structural panels, wherein the structural panels have a closed position covering the gate and an open position revealing the gate, wherein the structural panels are selected from the group of panels consisting of laterally reciprocating panels, access panels, panel inserts, convertible deck panels, and a combination thereof.

18. The extendable multihull boat of claim 16, wherein the amidships hull is at least one of a monohull and a pair of spaced apart pontoons, wherein the monohull is further comprised of a bulkhead, a well, and a storage hold, wherein the gate closes the well of the monohull in the raised position and opens the well of the monohull in the lowered position, wherein the spaced apart pontoons are further comprised of a first brace connecting the spaced apart pontoons, wherein the proximal section of the gate serves as a second brace connecting the spaced apart pontoons, and wherein the first brace is located at a position spaced away from the second brace.

19. The extendable multihull boat of claim 16, wherein the actuator is selected from the group of actuators consisting of a centerline actuator and a pair of side actuators.

20. The extendable multihull boat of claim 16, further comprising a support connecting the distal section of the gate to the amidships hull, and an actuator operatively connected to at least one of the distal section of the gate and the support.

* * * * *